US007671824B2

(12) United States Patent
Yoon et al.

(10) Patent No.: US 7,671,824 B2
(45) Date of Patent: Mar. 2, 2010

(54) PLASMA DISPLAY AND DRIVING METHOD THEREOF

(75) Inventors: Won Sik Yoon, Gumi-si (KR); Yang Keun Lee, Gumi-si (KR); Won Soon Kim, Gumi-si (KR); Jang Hwan Cho, Chilgok-gun (KR)

(73) Assignee: LG Electronics Inc., Seoul (KR)

( * ) Notice: Subject to any disclaimer, the term of this patent is extended or adjusted under 35 U.S.C. 154(b) by 1098 days.

(21) Appl. No.: 11/319,731

(22) Filed: Dec. 29, 2005

(65) Prior Publication Data

US 2006/0164358 A1 Jul. 27, 2006

(30) Foreign Application Priority Data

Dec. 31, 2004 (KR) ..... 10-2004-0118588

(51) Int. Cl.
*G09G 3/28* (2006.01)

(52) U.S. Cl. ..... 345/63; 345/60

(58) Field of Classification Search ..... 345/60–63, 345/66–68; 315/169.2–169.4
See application file for complete search history.

(56) References Cited

U.S. PATENT DOCUMENTS

| | | | | |
|---|---|---|---|---|
| 6,628,275 | B2 * | 9/2003 | Vossen et al. | 345/211 |
| 6,680,581 | B2 * | 1/2004 | Lee et al. | 315/169.3 |
| 6,781,322 | B2 * | 8/2004 | Onozawa et al. | 315/169.3 |
| 6,961,031 | B2 * | 11/2005 | Lee et al. | 345/60 |
| 7,027,010 | B2 * | 4/2006 | Lee | 345/60 |
| 7,123,219 | B2 * | 10/2006 | Lee | 345/76 |
| 2003/0025459 | A1 | 2/2003 | Lee et al. | |
| 2003/0085886 | A1 | 5/2003 | Ide et al. | |
| 2004/0004610 | A1 | 1/2004 | Iwami et al. | |
| 2004/0012546 | A1 * | 1/2004 | Takagi et al. | 345/60 |
| 2004/0036686 | A1 | 2/2004 | Cho et al. | |
| 2004/0104866 | A1 * | 6/2004 | Sano et al. | 345/60 |
| 2004/0135746 | A1 * | 7/2004 | Lee et al. | 345/60 |
| 2005/0029960 | A1 | 2/2005 | Roh et al. | |
| 2006/0267874 | A1 * | 11/2006 | Chen et al. | 345/68 |

FOREIGN PATENT DOCUMENTS

| | | |
|---|---|---|
| CN | 1335974 | 2/2002 |
| EP | 0810576 A1 | 3/1997 |
| EP | 0899709 A2 | 3/1999 |
| EP | 1152387 A1 | 11/2001 |
| JP | 9-146490 | 6/1997 |
| JP | 11-282416 | 10/1999 |
| JP | 2000-338934 | 12/2000 |

(Continued)

*Primary Examiner*—Ricardo L Osorio
(74) *Attorney, Agent, or Firm*—McKenna Long & Aldridge LLP

(57) ABSTRACT

A plasma display panel for adaptively reducing load effect and improving luminescence efficiency and discharge efficiency, and a driving method thereof. A plasma display panel includes a capacitive load; a source capacitor; a sustain voltage source to generate a sustain voltage; a first inductor formed on a first current path where a current flows from the capacitive load to the source capacitor; a second inductor formed on a second current path where a current flows from the source capacitor to the capacitive load; a switch configuration and switch control circuit that controls the switching operations of the switch configuration such that at least two discharges may occur during one sustain pulse cycle.

36 Claims, 21 Drawing Sheets

FOREIGN PATENT DOCUMENTS

| | | |
|---|---|---|
| JP | 2001-331147 | 11/2001 |
| JP | 2002-006806 | 1/2002 |
| JP | 2003-338239 | 11/2003 |
| JP | 2004-133406 | 4/2004 |
| JP | 2004-177815 | 6/2004 |
| JP | 2004-326104 | 11/2004 |
| KR | 2003-0025543 | 3/2003 |
| KR | 2003-0065891 | 8/2003 |
| TW | 516015 | 1/2003 |
| TW | 530281 | 5/2003 |
| WO | WO 01/37250 A1 | 5/2001 |

* cited by examiner

PLASMA DISPLAY AND DRIVING METHOD THEREOF

This application claims the benefit of the Korean Patent Application No. P2004-118588 filed on Dec. 31, 2004, which is hereby incorporated by reference.

BACKGROUND OF THE INVENTION

1. Field of the Invention

The present invention relates to a plasma display panel, and more particularly to a plasma display panel that is adapted for reducing load effect and improving luminescence efficiency and discharge efficiency, and a driving method thereof.

2. Description of the Related Art

Recently, various flat panel displays, which generally weigh less and are smaller in size than might reduce cathode ray tubes, have been developed. These flat panel displays include liquid crystal displays (hereinafter 'LCD'), field emission displays (hereinafter 'FED'), plasma display panels (hereinafter 'PDP') and electro-luminescence EL displays.

The PDP, in particular, uses a gas discharge and it has the advantage that it can be easily produced in a large sized panel. FIG. 1 shows a common three electrode AC surface discharge PDP, which employs three electrodes and is driven by AC voltage.

Referring to FIG. 1, the discharge cell of the three electrode AC surface discharge PDP includes a scan electrode Y and a sustain electrode Z formed on an upper substrate 10, an address electrode X formed on a lower substrate 18. Both the scan electrode Y and the sustain electrode Z include a transparent electrode 12Y, 12Z and a metal bus electrode 13Y, 13Z, where the metal bus electrode has a narrower width than the transparent electrode. Further, the metal bus electrode is formed at one side edge of the transparent electrode as shown.

The transparent electrodes 12Y, 12Z are formed of indium tin oxide (ITO) on the upper substrate 10 in the related art. The metal bus electrodes 13Y, 13Z are formed of a metal, such as chrome (Cr), on the transparent electrodes 12Y, 12Z and they reduce the voltage drop which is caused by the high resistivity of the transparent electrodes 12Y, 12Z. A dielectric layer 14 and a passivation film 16 are deposited on the upper substrate 10 where the scan electrode Y and the sustain electrode Z are formed in parallel. A wall charge generated, as a result of a plasma discharge, is accumulated in the upper dielectric layer 14. The passivation film 16 prevents the loss of the upper dielectric layer 14 caused by the sputtering associated with the plasma discharge. This increases the emission efficiency of secondary electrons. The passivation film 16 is made of magnesium oxide MgO in the related art.

A lower dielectric layer 22 is formed on the lower substrate 18 where the address electrode X is formed, and a phosphorus layer 26 is spread over the surface of barrier ribs 24 and the lower dielectric layer 22. The address electrode X is formed in a direction that crosses the scan electrode Y and the sustain electrode Z (i.e., a perpendicular direction). The barrier ribs 24 are formed parallel to the address electrode X to prevent ultraviolet and visible light, which are generated by the discharge, from leaking into adjacent discharge cells. The phosphorus layer 26 is excited by the ultraviolet light, which is generated upon the plasma discharge, to generate any one of red, green and blue visible light, depending on the type of phosphor coating that discharge cell. An inert gas mixture is injected into a discharge space between the upper/lower substrate 10, 18 and the barrier ribs 24.

Each display time frame for the three electrode AC surface discharge PDP is divided into a plurality of subfields, wherein the light emission associated with each subfield differs proportionally, thereby achieving various gray levels for displaying an image. Each subfield is further divided into a reset period, an address period, a sustain period and an erasure period.

Herein, the reset period is a period during which uniform wall charges are formed in the discharge cell. The address period is a period during which a selective address discharge is generated in accordance with the logical value of the video data, thus selecting or not selecting each discharge cell for illumination during that subfield. The sustain period is a period during which a discharge is maintained in those discharge cells that were selected during the address period. The erasure period is a period during which the sustain discharge generated during the sustain period is eliminated.

In AC surface discharge PDPs that are driven as described above, a high voltage of not less than several hundred volts is required to achieve the address discharge and the sustain discharge. Accordingly, an energy recovery unit is used for minimizing the power required to achieve the address discharge and the sustain discharge. The energy recovery unit recovers the voltage between the scan electrode 12Y and the sustain electrode 12Z, and utilizes the recovered voltage as a driving voltage for the next discharge.

FIG. 2 depicts an energy recovery unit 30, 32 for a PDP as proposed in U.S. Pat. No. 5,081,400. As shown, the energy recovery units 30, 32 are symmetrically installed with a capacitive load Cp, i.e., a panel capacitor therebetween. The panel capacitor Cp equivalently represents the capacitance which is formed between the scan electrode Y and the sustain electrode Z. The first energy recovery unit 30 supplies a sustain voltage to the scan electrode Y and the second energy recovery unit 32 supplies the sustain voltage to the sustain electrode Z. The first energy recovery unit 30 and the second energy recovery unit 32 alternate in operation with respect to each other.

The components of the energy recovery units 30, 32 of the related art PDP are now described with reference to the first energy recovery unit 30. Otherwise, the first and second energy recovery units 30, 32 are the same. The first energy recovery unit 30 includes an inductor L connected between the panel capacitor Cp and a source capacitor Cs; first and third switches S1, S3 connected in parallel between the source capacitor Cs and the inductor L; a second switch S2 connected between a sustain voltage source Vs and a first node N1 between the panel capacitor Cp and the inductor L; and a fourth switch S4 connected between the first node N1 and a ground voltage source GND.

The source capacitor Cs recovers the voltage stored in the panel capacitor Cp during a sustain discharge, and it re-supplies voltage to the panel capacitor Cp. The voltage of Vs/2 corresponding to half the value of the sustain voltage Vs charges the source capacitor Cs. The inductor L forms a resonance circuit together with the panel capacitor Cp. To achieve this, the first through the fourth switches S1 to S4 control the flow of electric current. On the other hand, the fifth and sixth diodes D5, D6 each installed between the first and second switches S1, S2 and the inductor L prevent the current from flowing in a reverse direction.

FIG. 3 is a timing and waveform diagram representing the output waveform of the panel capacitor Cp and the corresponding switching states of the switches S1 through S4 of the first energy recovery unit 30.

Before period T1, it is assumed that the panel capacitor Cp has a charge of 0 volts, and the source capacitor Cs has a charge of Vs/2 volts. The operation of the first energy recovery unit 30 is now described in detail.

During the period T1, the first switch S1 is turned on to form a current path from the source capacitor Cs to the panel capacitor Cp through the first switch S1 and the inductor L. Accordingly, the voltage Vs/2 stored in the source capacitor Cs is supplied to the panel capacitor Cp. At this moment, the inductor L and the panel capacitor Cp form a series resonance circuit, thus the sustain voltage Vs, which is double the voltage Vs/2 of the source capacitor Cs, charges the panel capacitor Cp.

During the period T2, the first switch S1 remains in an on-state and the second switch S2 is turned on. When the second switch S2 is turned on, the sustain voltage Vs from the sustain voltage source is supplied to the scan electrode Y. The sustain voltage Vs supplied to the scan electrode Y prevents the voltage of the panel capacitor Cp from dropping below the sustain voltage Vs, thus causing the sustain discharge to be generated in a normal manner. Because the panel capacitor Cp is charged to the sustain voltage Vs during the period T1, the amount of drive power supplied from the outside needed to generate the sustain discharge is minimized.

At the beginning of the period T3, the first switch S1 is turned off. During the period T3, the scan electrode Y remains at the sustain voltage Vs.

At the beginning of the period T4, the second switch S2 is turned off and the third switch is turned on. When the third switch S3 is turned on, a current path forms from the panel capacitor Cp to the source capacitor Cs through the inductor L and the third switch to recover the voltage stored in the panel capacitor Cp. At this moment, the source capacitor Cs charges to the voltage of Vs/2.

At the beginning of the period T5, the third switch S3 is turned off and the fourth switch S4 is turned on. When the fourth switch S4 is turned on, a current path forms between the panel capacitor Cp and the ground voltage source GND, thus the voltage of the panel capacitor Cp drops to 0V.

During the period T6, the state of the switches S1 through S4 and the 0V stored at the panel capacitor Cp are maintained. An AC drive pulse supplied to the scan electrode Y is achieved by repeating the aforementioned switching sequence at a predefined interval.

On the other hand, the second energy recovery unit 32 alternately supplies the drive voltage to the panel capacitor Cp. Accordingly, the panel capacitor Cp receives a sustain voltage Vs that has a different polarity. In this way, the sustain voltage Vs having the different polarity is supplied to the panel capacitor Cp, thus the sustain discharge is generated at the discharge cells.

However, the discharge efficiency, the luminescence efficiency and the power consumption associated with the related art energy recovery units varies in accordance with the load effect of the PDP. This is a problem because the picture quality of the PDP then changes in accordance with the load of the PDP. For instance, if the PDP load is small, one discharge is generated for each sustain pulse; but, on the other hand, if the PDP load is relatively big, two discharges may occur for one sustain pulse. Accordingly, a PDP design and method are needed that increase PDP display quality regardless of load.

SUMMARY OF THE INVENTION

Accordingly, it is an object of the present invention to provide a plasma display panel that is adapted for reducing load effect, and a driving method thereof.

It is another object of the present invention to provide a plasma display panel that is adapted for improving luminescence efficiency and discharge efficiency, and a driving method thereof.

In accordance with a first aspect of the present invention, these and other objects are achieved by a plasma display panel that comprises a capacitive load, a source capacitor, a sustain voltage source, a first inductor on a first current path from the capacitive load to the source capacitor, and a second inductor on a second current path from the source capacitor to the capacitive load. In addition, the plasma display panel comprises a first switch connected between the capacitive load and the sustain voltage source, a second switch connected between a first node on the first current path and a second node on the second current path, and a third switch connected between the capacitive load and a ground voltage source. The plasma display panel also comprises a switch control circuit configured to control the switches in order to generate a first discharge and a second discharge during one sustain pulse.

In accordance with a second aspect of the present invention, the aforementioned and other objects are achieved by a plasma display panel that comprises capacitive load, a source capacitor, a sustain voltage source, a first inductor on a first current path from the capacitive load to the source capacitor, and a second inductor on a second current path from the source capacitor to the capacitive load. In addition, the plasma display panel comprises a first switch connected between the source capacitor and the second inductor, a second switch connected between the sustain voltage source and the capacitive load, a third switch connected between the source capacitor and the first inductor on the first current path, and a fourth switch connected between the capacitive load and a ground voltage source. Still further, the plasma display panel comprises a switch control circuit configured to control the switches so as to generate a first discharge a second discharge during one sustain pulse.

In accordance with a third aspect of the present invention, the aforementioned and other objects are achieved by a plasma display panel that comprises a capacitive load, a source capacitor, a sustain voltage source, a first inductor on a first current path from the capacitive load to the source capacitor, and a second inductor on a second current path from the source capacitor to the capacitive load. In addition, the plasma display panel also comprises a first switch connected between the capacitive load and the sustain voltage source, a second switch connected between a first node on the first current path and a second node on the second current path, and a third switch connected between the capacitive load and a ground voltage source, where the first inductor and the second inductor are magnetically coupled.

In accordance with a fourth aspect of the present invention, the aforementioned and other objects are achieved by a plasma display panel that comprises a capacitive load, a source capacitor, a sustain voltage source to generate a sustain voltage, a first inductor on a first current path from the capacitive load to the source capacitor, and a second inductor on a second current path from the source capacitor to the capacitive load. In addition, the plasma display panel comprises a first switch connected between the source capacitor and the second inductor, a second switch connected between the sustain voltage source and the capacitive load, a third switch connected between the source capacitor and the first inductor on the first current path, and a fourth switch connected between the capacitive load and a ground voltage source, where the first inductor and the second inductor are magnetically coupled.

In accordance with a fifth aspect of the present invention, the aforementioned and other objects are achieved by a plasma display panel that comprises a capacitive load, a first driver supplying a sustain pulse to a first electrode of the capacitive load, and a second driver supplying a sustain pulse to a second electrode of the capacitive load. Moreover, at least one of the first and the second drivers is configured to generate a sustain pulse that exhibits a first rise in voltage to a first voltage level, and then a second rise in voltage from a second voltage level to a third voltage level, where the second voltage is less than the first voltage and greater than 0V.

In accordance with a sixth aspect of the present invention, the aforementioned and other objects are achieved by a plasma display panel that comprises a capacitive load, a first driver supplying a sustain pulse to a first electrode of the capacitive load and a second driver supplying a sustain pulse to a second electrode of the capacitive load. In addition, the plasma display panel also comprises a controller configured to modulate a sustain pulse generated by at least one of the first driver and the second driver, such that a first discharge and a second discharge are generated during one sustain pulse cycle based on the amount of display data in a given subfield.

In accordance with a seventh aspect of the present invention, the aforementioned and other objects are achieved by a driving method of a plasma display panel. The driving display panel includes a capacitive load, a source capacitor, a sustain voltage source, a first inductor on a first current path from the capacitive load and the source capacitor, a second inductor on a second current path from the source capacitor to the capacitive load, the second inductor coupled to and parallel with the first inductor, and a sustain voltage source. The method comprises supplying a ground voltage level to the capacitive load, storing energy from the source capacitor at the second inductor, and charging the capacitive load by supplying the energy stored at the second inductor to the capacitive load. The method then involves discharging the energy stored at the capacitive load and supplying a sustain voltage from the sustain voltage source to the capacitive load. Still further, the method involves storing the energy from the capacitive load at the first inductor and charging the source capacitor by supplying the energy stored at the first inductor to the source capacitor.

In accordance with an eighth aspect of the present invention, the aforementioned and other objects are achieved by a driving method of a plasma display panel. The method involves applying a sustain pulse to a capacitive load, where the sustain pulse exhibits a voltage that increases to a first voltage level and increases from a second voltage level to a third voltage level, and where the second voltage level is less than the first voltage and greater than 0V.

In accordance with a ninth aspect of the present invention, the aforementioned and other objects of the present invention are achieved by a driving method of a plasma display panel. The method involves determining the amount of data corresponding to a given subfield. Then, based on the amount of data corresponding to the subfield, modulating a sustain pulse, such that at least two discharges are generated at a capacitive load during one sustain pulse cycle.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings. Hereinafter, the preferred embodiments of the present invention will be described in detail with reference to FIGS. 4 to 20.

Figure 1:
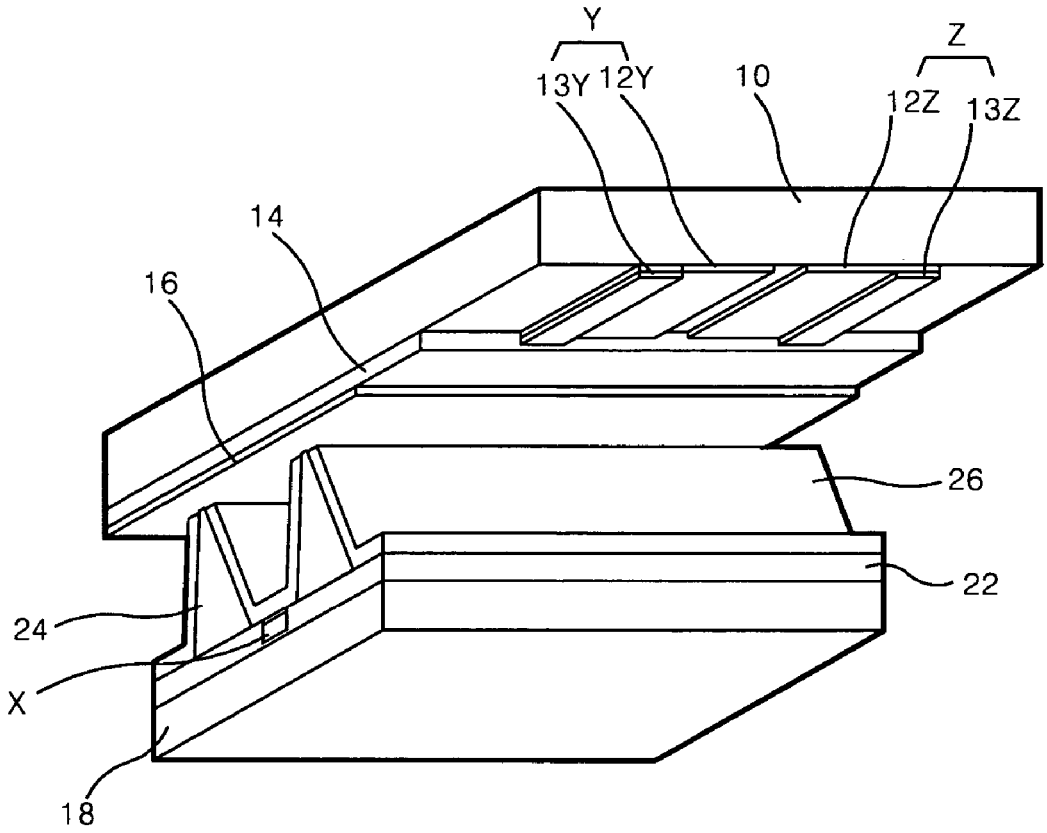
FIG. 1 RELATED ART
FIG. 1 is a perspective view representing a related art three electrode AC surface discharge PDP.
Figure 2:
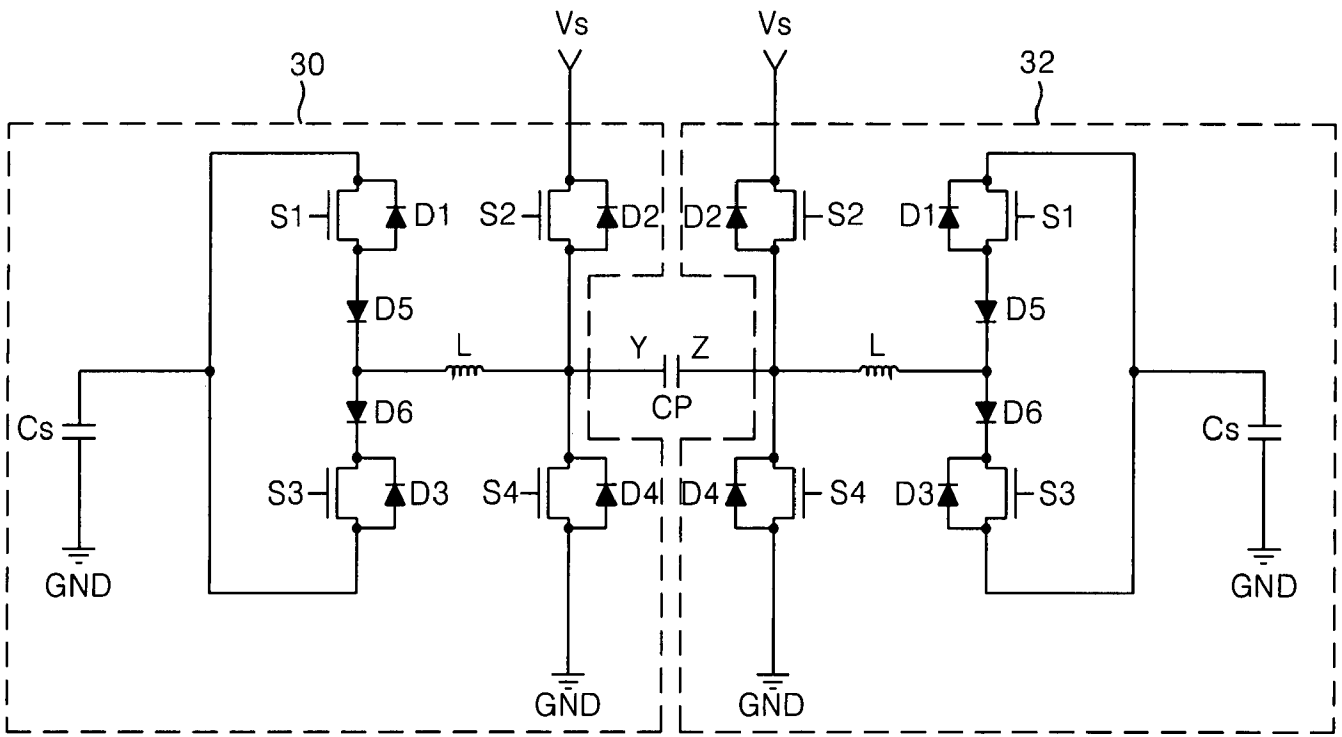
FIG. 2 RELATED ART
FIG. 2 is a circuit diagram representing an energy recovery unit of the related art PDP.
Figure 3:
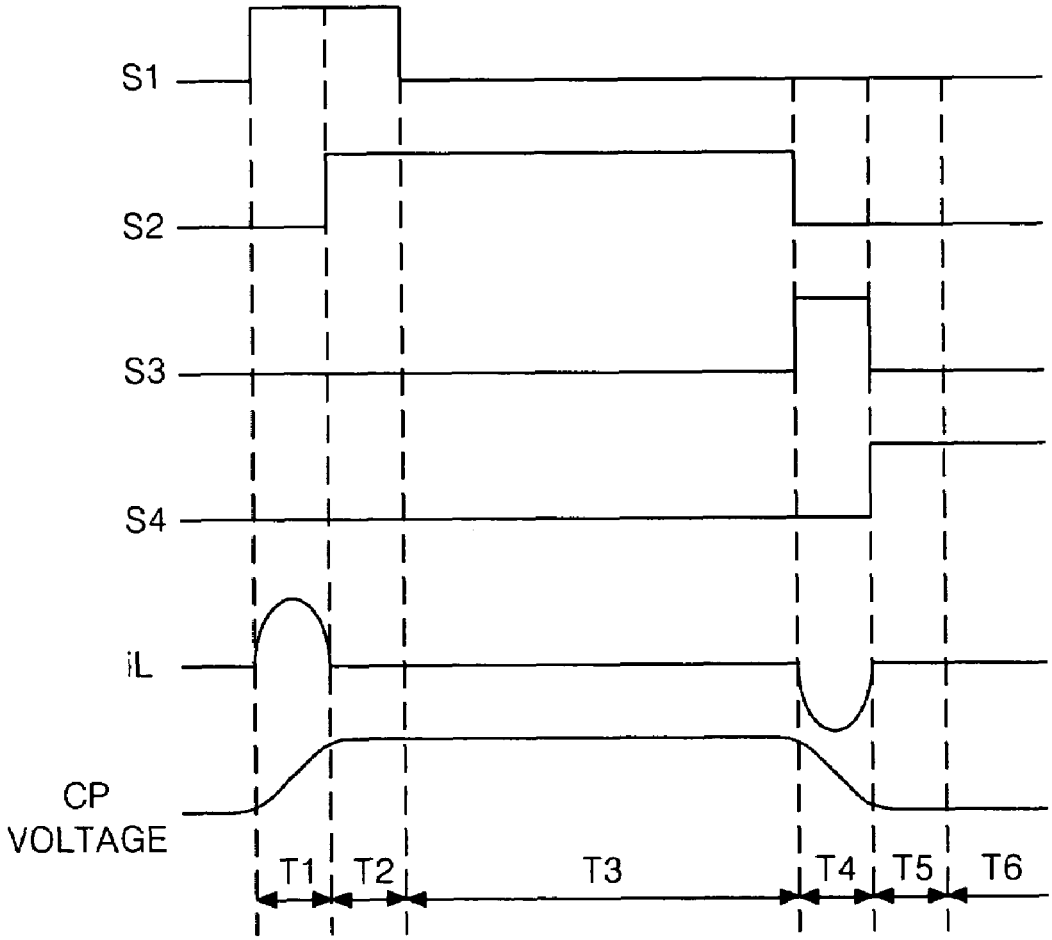
FIG. 3 RELATED ART
FIG. 3 is a timing and waveform diagram representing the output waveform of a panel capacitor and the switching states for the switches shown in FIG. 2.
Figure 4:
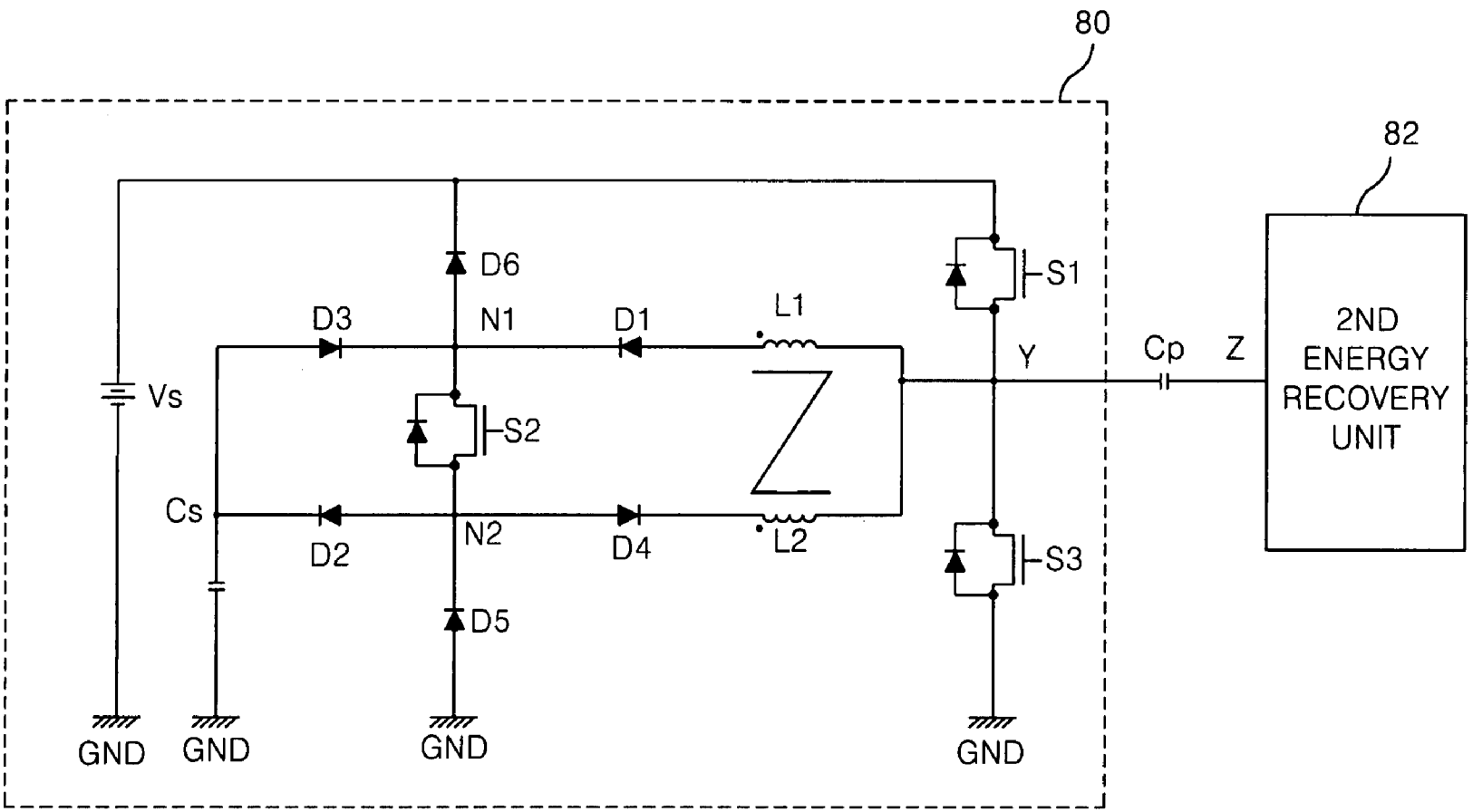
FIG. 4 is a circuit diagram representing an energy recovery unit of a plasma display panel according to a first embodiment of the present invention.

FIG. 4 is a diagram representing an energy recovery unit of a plasma display panel according to a first embodiment of the present invention. Referring to FIG. 4, the energy recovery unit of the plasma display panel according to the first embodiment of the present invention includes a panel capacitor Cp comprising a scan electrode Y and a sustain electrode Z; and first and second energy recovery units 80, 82 to supply a sustain voltage to the sustain electrode Z and the scan electrode Y of the panel capacitor Cp.

The first energy recovery unit 80 includes a sustain voltage source Vs to supply a sustain voltage Vs to the panel capacitor Cp; a source capacitor Cs to recovery the energy stored at the panel capacitor; first and second inductors L1, L2 connected in parallel between the scan electrode Y of the panel capacitor Cp and the source capacitor Cs; a first switch S1 connected between the scan electrode Y of the panel capacitor Cp and the sustain voltage source Vs; a third switch S3 connected between the scan electrode Y of the panel capacitor Cp and a ground voltage source GND; first and third diodes D1 and D3 connected in series between the first inductor L1 and the source capacitor Cs; second and fourth diodes D2, D4 connected in series between the second inductor L2 and the source capacitor Cs; a second switch S2 connected between a first node N1 between first and third diodes D1, D3 and a second node N2 between the second and fourth diodes D2, D4; a fifth diode D5 connected between the second node N2 and the ground voltage source GND; and a sixth diode D6 connected between the first node N1 and the sustain voltage source Vs.

The panel capacitor Cp equivalently represents the capacitance which is formed between the scan electrode Y and the sustain electrode Z of the PDP. The panel capacitor Cp generates a sustain discharge as a result a sustain voltage.

The source capacitor Cs supplies the energy, stored therein, to the panel capacitor Cp to charge the panel capacitor Cp, and also to recover the energy stored in the panel capacitor Cp.

The first and second inductors L1, L2 are magnetically coupled. That is, the first and second inductors L1, L2 may be implemented by winding two coils in one core. The first and second inductors L1, L2 are connected in parallel between the panel capacitor Cp and the source capacitor Cs, and they recover the energy from the panel capacitor Cp in accordance with the switching state of the first, second and third switches S1, S2, S3 by storing the energy. They also recover the energy from the source capacitor Cs by storing the recovered energy. When this occurs, the first inductor L1 supplies the energy stored by an LC resonance with the source capacitor Cs to the source capacitor Cs, and the second inductor L2 supplies the energy stored by the LC resonance with the panel capacitor to the panel capacitor Cp. The first and second inductors L1, L2 might have the same inductance or different inductances. If the first and second inductors L1, L2 have the same inductance, the time required to charge and discharge the panel capacitor Cp is the same. Otherwise, if the inductance of the second inductor L2 is larger than the inductance of the first inductor L1, the time required to charge the panel capacitor Cp is faster and the discharge time is slower. Thus, the discharge efficiency and the energy recovery efficiency can be improved.

The first switch S1 is switched in accordance with a first switching signal to electrically connect the sustain voltage source Vs with the scan electrode Y of the panel capacitor Cp. Accordingly, the sustain voltage Vs of the sustain voltage source Vs is supplied to the scan electrode Y of the panel capacitor Cp. The second switch S2 is switched in accordance with a second switching signal to electrically connect the first node N1 with the second node N2. Thus, the energy stored at the source capacitor Cs is not only supplied to the scan electrode Y of the panel capacitor Cp, but the energy stored at the panel capacitor Cp is also supplied to the source capacitor Cs. The second switching signal remains in a high state for not less than ¼ of a period when the sustain voltage is supplied to the scan electrode Y. The third switch S3 is switched in accordance with the third switching signal to electrically connect the scan electrode Y of the panel capacitor Cp with the ground voltage source GND. Accordingly, the ground voltage GND is supplied to the scan electrode Y of the panel capacitor Cp. The first to third switches S1 to S3 are turned on and off in accordance with the first to third signals for controlling the flow of electric current, where each of the first to third switches S1 to S3 is composed of a semiconductor switch device, e.g., any one of MOSFET, IGBT, SCR, BJT.

The first to fourth diodes D1 to D4 are connected to form a bridge around the second switch S2, where the diodes D1 to D4 further form a first loop and a second loop when the first switch S1 is turned on and off. The first loop is for supplying the energy stored at the source capacitor Cs to the panel capacitor Cp and the second loop is for supplying the energy stored at the panel capacitor Cp to the source capacitor Cs. With regard to the first loop, the first diode D1 is connected between the first inductor L1 and the first node N1 that is one side of the second switch S2, and the second diode D2 is connected between the source capacitor Cs and the second node N2 that is the other side of the second switch S2. Further, the third diode D3 is connected between the source capacitor Cs and the first node N1, and the fourth diode D4 is connected between the second node N2 and the second inductor L2. The fifth diode D5 is connected between the ground voltage source GND and the second node N2 in order to sustain the voltage of the second node N2. The sixth diode D6 is connected between the first node N1 and the sustain voltage source Vs in order to prevent a reverse current from the sustain voltage source Vs from flowing in the first node N1.

The second energy recovery unit 82 might be configured in the same manner as the first energy recovery unit 80 or in the same manner as the related art circuit. On the other hand, the first energy recovery unit 80 may be configured in the same manner as the related art circuit and the second energy recovery unit 82 might be configured as is the first energy recovery unit 80 of FIG. 4.

Figure 5A:
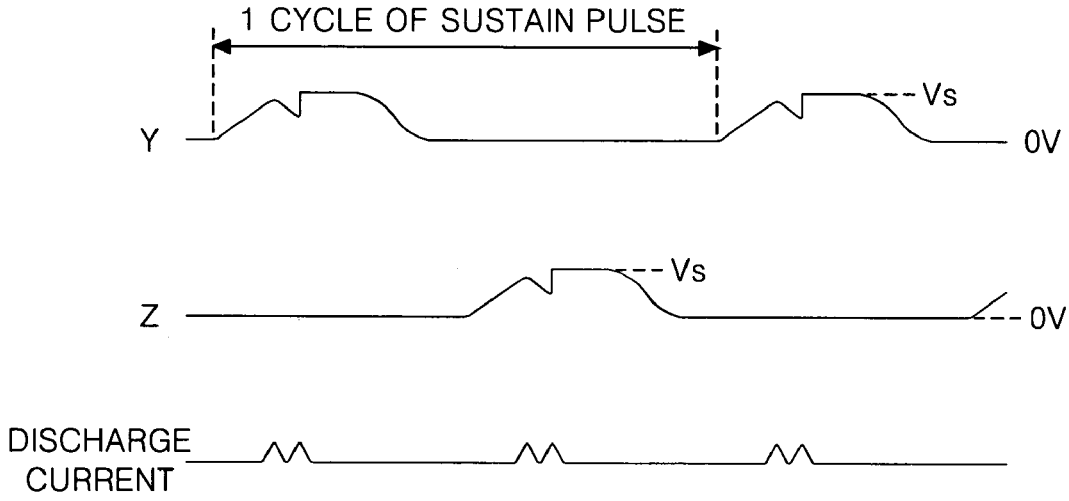
FIGS. 5A and 5B are waveform diagrams representing the discharge current and sustain pulses generated by the energy recovery unit of FIG. 4.
Figure 5B:
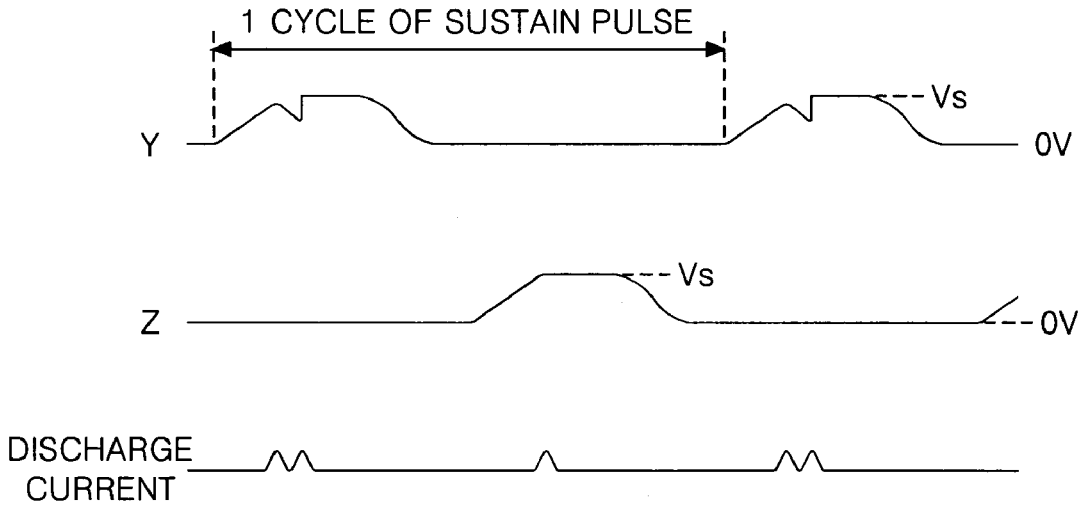

The first energy recovery unit 80 of FIG. 4, as shown in FIGS. 5A and 5B, first increases the voltage of the sustain pulse towards the sustain voltage Vs to induce a first discharge. Second it increases the voltage to the sustain voltage Vs to induce a second discharge. Accordingly, in case that the scan electrode Y is driven by the first energy recovery unit 80 of FIG. 4 and the sustain electrode Z is driven with the same energy circuit configuration, a discharge is generated four times during each sustain pulse cycle, as shown in FIG. 5A. If, however, the scan electrode Y is driven by the first energy recovery unit 80 of FIG. 4 and the sustain electrode Z is driven by a related art sustain drive circuit, a discharge is generated three times during each sustain pulse cycle as shown in FIG. 5B. Herein, each sustain pulse cycle covers a period of time from the beginning of the rising edge of one sustain pulse to the beginning of the rising edge of the next sustain pulse as illustrated in FIGS. 5A and 5B. Where the sustain pulse is alternately applied to the scan electrode Y and the sustain electrode Z, one sustain pulse is applied to the scan electrode Y and one sustain pulse is applied to the sustain electrode Z during each sustain pulse cycle.

Figure 6:
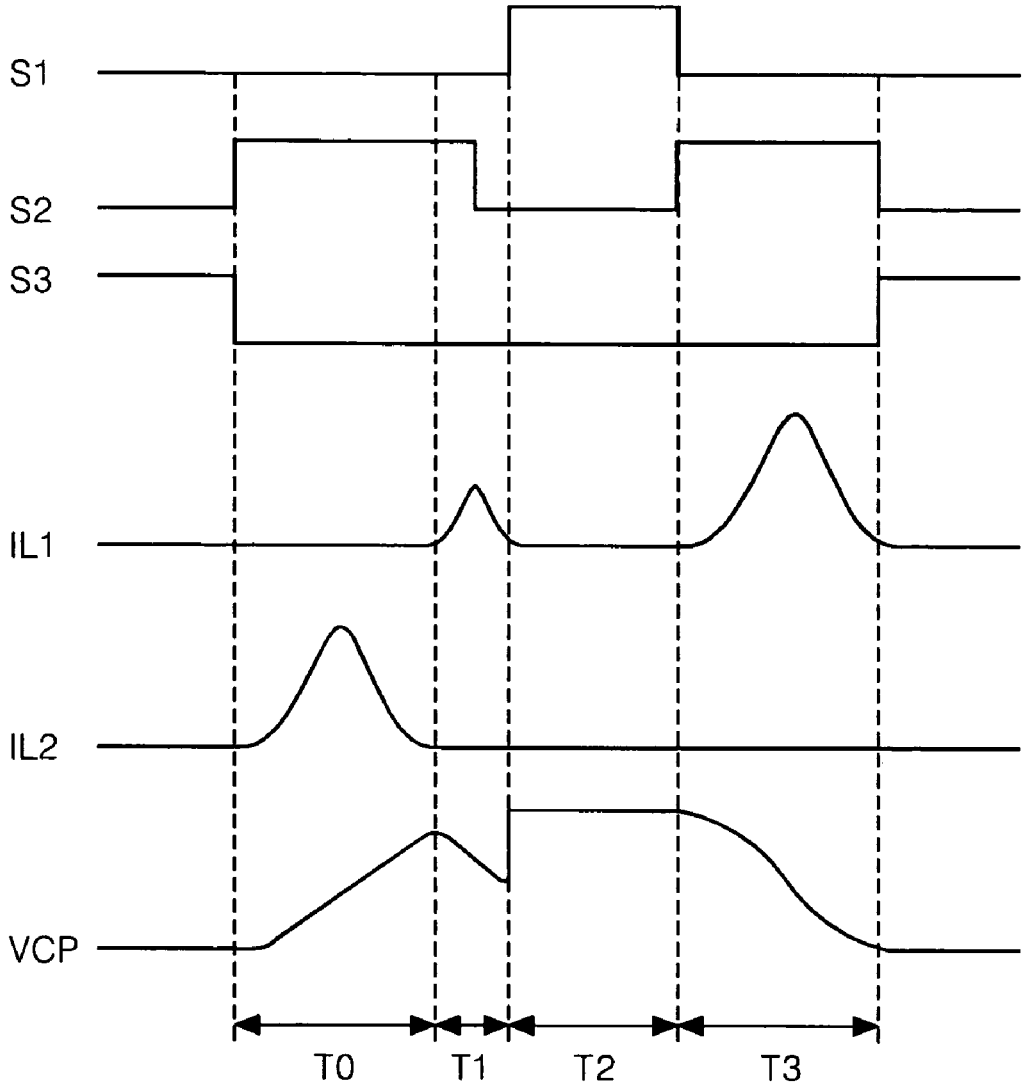
FIG. 6 is a timing and waveform diagram representing the output waveform of a panel capacitor and the switching states for the switches shown in FIG. 4.
Figure 7:
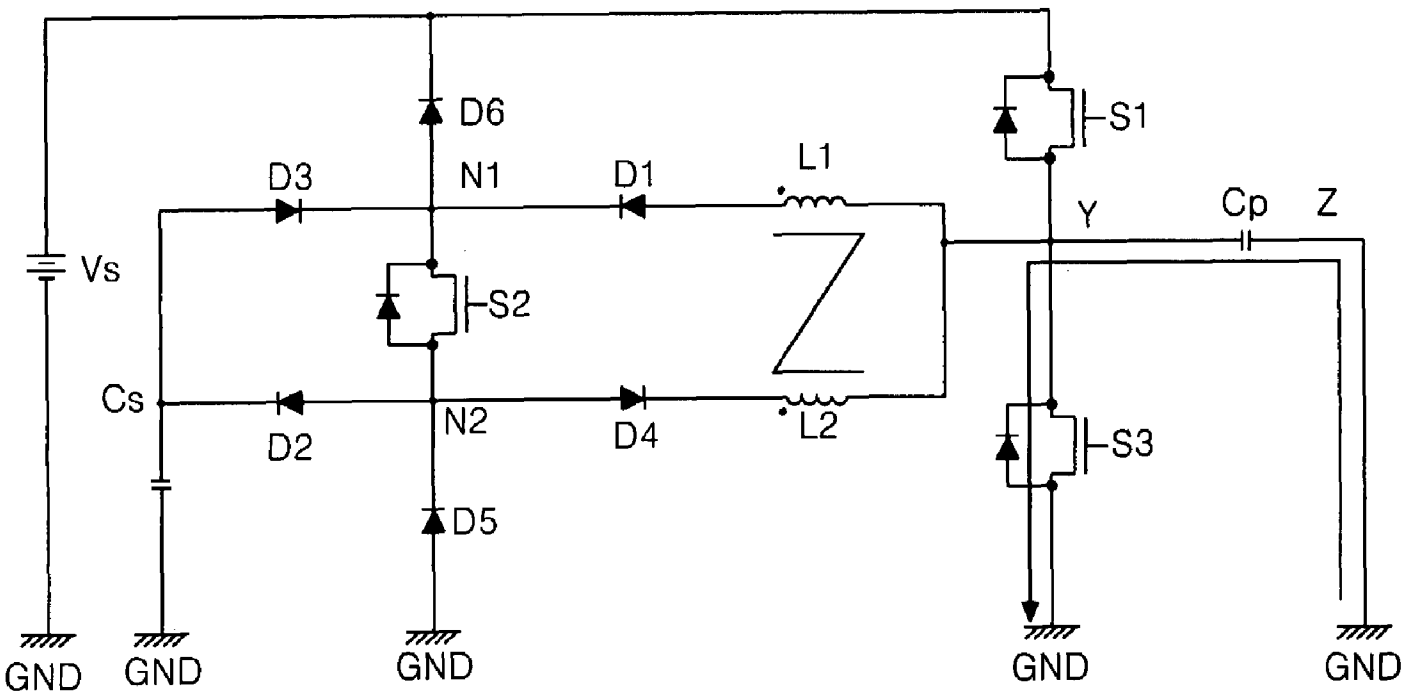
FIG. 7 is a circuit diagram representing the current path in accordance with the switching state for the switches before the T0 period shown in FIG. 6.

FIG. 6 is a timing and waveform diagram representing the inductor current and the voltage applied to the panel capacitor given the switching states of the switches shown in FIG. 4. Herein, it is assumed that the sustain voltage Vs is stored at the source capacitor Cs.

Referring to FIG. 6, the third switch S3 is first turned on under the control of a third switching signal before the T0 period. Accordingly, a loop is formed from the ground voltage source GND to the ground voltage source GND through the panel capacitor Cp and the third switch S3. Because of this, the ground voltage GND is supplied to the scan electrode Y of the panel capacitor Cp, thus the panel capacitor Cp remains at a ground voltage GND level.

Figure 8:
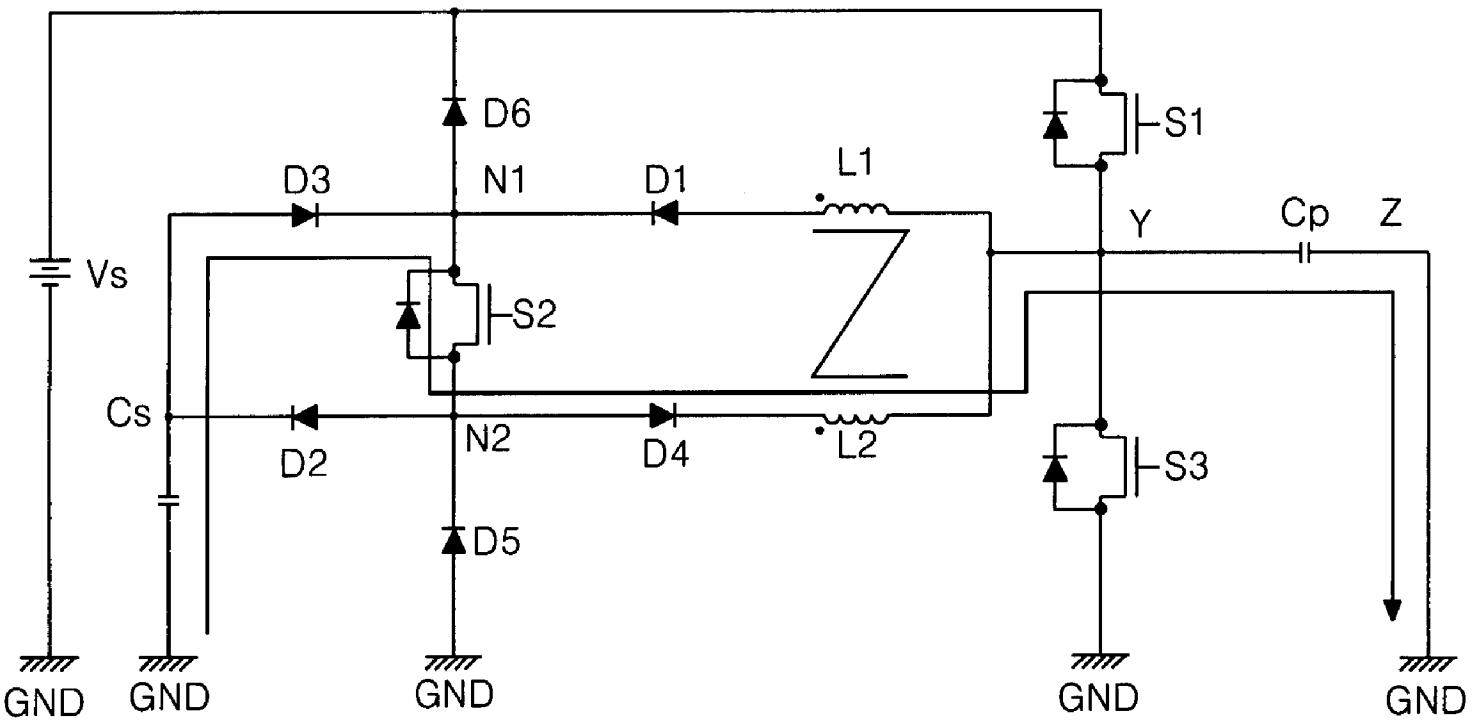
FIG. 8 is a circuit diagram representing the current path in accordance with the switching state for the switches during the T0 period shown in FIG. 6.
Figure 9:
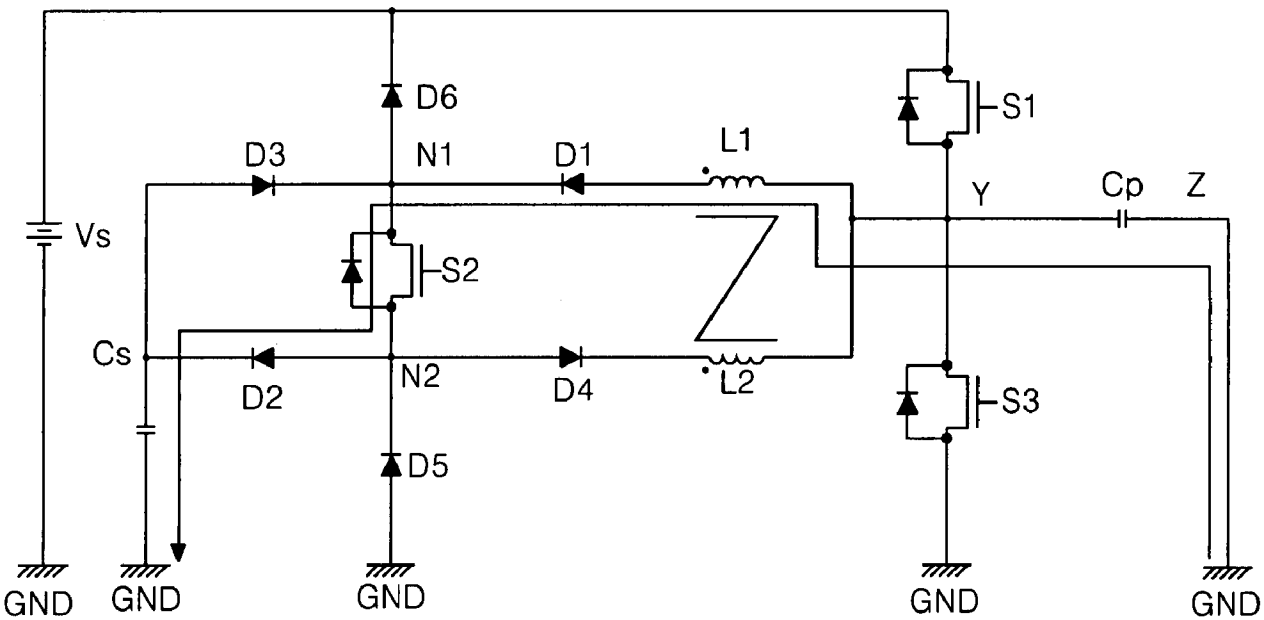
FIG. 9 is a circuit diagram representing the current path in accordance with the switching state for the switches during the T0 and T3 periods shown in FIG. 6.

During the T0 period, the third switch S3 is turned off (i.e., transitions to a low state) and the second switch is turned on (i.e., transitioned to a high state). Thereafter, the second switching signal remains at the high state for not less than ¼ of a period where the panel capacitor Cp is being charged to Vs. That is, the second switch S2 remains at the on state after a point in time when the current flowing in the second inductor L2 becomes 0. Accordingly, if the second switching signal remains at the high state until the ¼ of the period, as shown in FIG. 8, there is formed a current path from the source capacitor Cs to the scan electrode Y of the panel capacitor Cp through the third diode D3, the first node N1, the second switch S2, the second node N2, the fourth diode D4 and the second inductor L2. This results in the source capacitor Cs, the second inductor L2 and the panel capacitor Cp forming a resonance loop. Hereby, the source capacitor Cs supplies the energy, which is stored in the second inductor L2. Accordingly, a positive(+) current flows in the second inductor L2 as shown in FIG. 6. At this moment, if the energy stored at the second inductor L2 becomes maximized, i.e., the current flowing in the second inductor L2 is maximized, the second inductor L2 supplies the energy, stored therein by the LC resonance, to the panel capacitor Cp. Accordingly, the panel capacitor Cp is charged with the voltage that rises from the ground voltage GND to the sustain voltage Vs, and the current flowing in the second inductor L2 decreases. If the second switching signal remains in the high state for not less than the ¼ of the period, i.e., after the point of time when the current flowing in the second inductor L2 is 0, as shown in FIG. 9, there is formed a current path from the panel capacitor Cp to the source capacitor Cs through the first inductor L1, the first diode D1, the first node N1, the second switch S2, the second node N2 and the second diode D2. At this point, the panel capacitor Cp forms a resonance loop with the first inductor L1, thus it supplies the energy, stored by the LC resonance to the first inductor L1. Accordingly, a positive(+) current flows in the first inductor L1 that is magnetically coupled with the second inductor L2. The second switching signal does not remain in the high state long enough for all the energy stored at the panel capacitor Cp to be supplied to the first inductor L1, thus a smaller amount of current flows through the inductor L1 as compared to the second inductor L2, as shown in FIG. 6. Accordingly, the panel capacitor Cp discharges only a designated amount energy stored therein.

Figure 10:
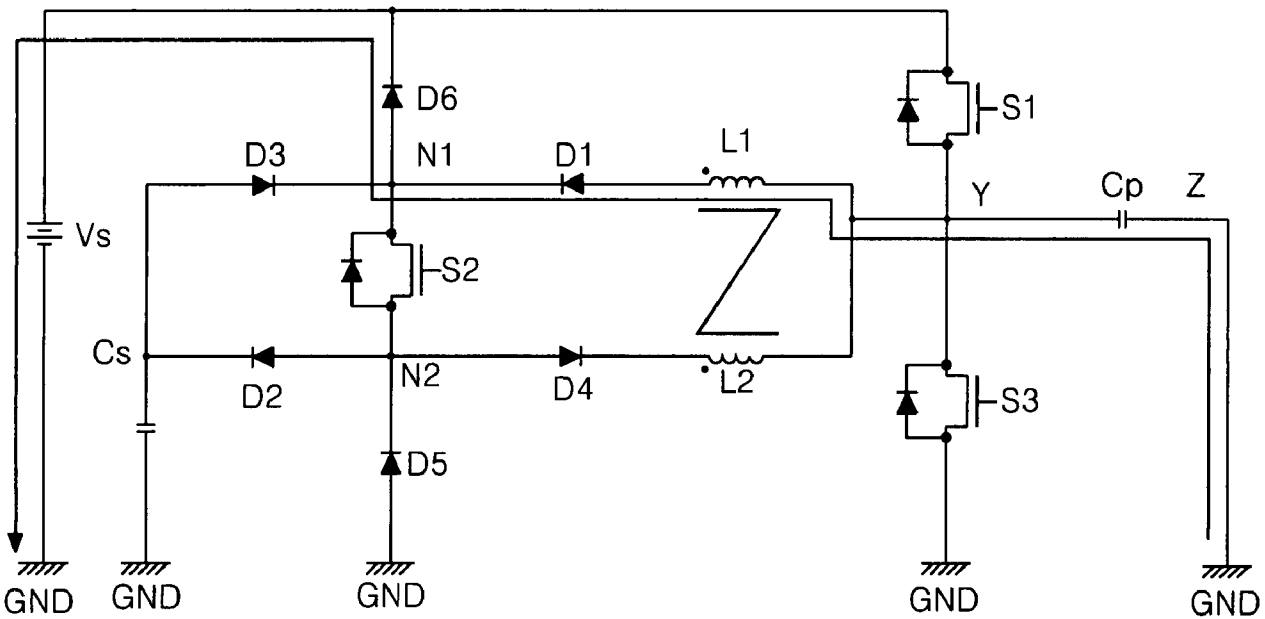
FIG. 10 is a circuit diagram representing the current path in accordance with the switching state for the switches during the T1 period shown in FIG. 6.

During the T1 period, the second switch S2 is turned off in accordance with the low state of the second switching signal. Accordingly, as shown in FIG. 10, a current path is formed from the ground voltage source GND to the sustain voltage source Vs through the panel capacitor Cp, the first inductor L1, the first diode D1, the first node N1 and the sixth diode D6. As a result, the panel capacitor Cp supplies a part of the energy stored therein to the first inductor L1 following to the T0 period. The voltage at the panel capacitor Cp decreases and the positive(+) current flowing in the first inductor L1 is recovered to the sustain voltage source Vs, thus the current flowing in the first inductor L1 decreases, as shown in FIG. 6.

Figure 11:
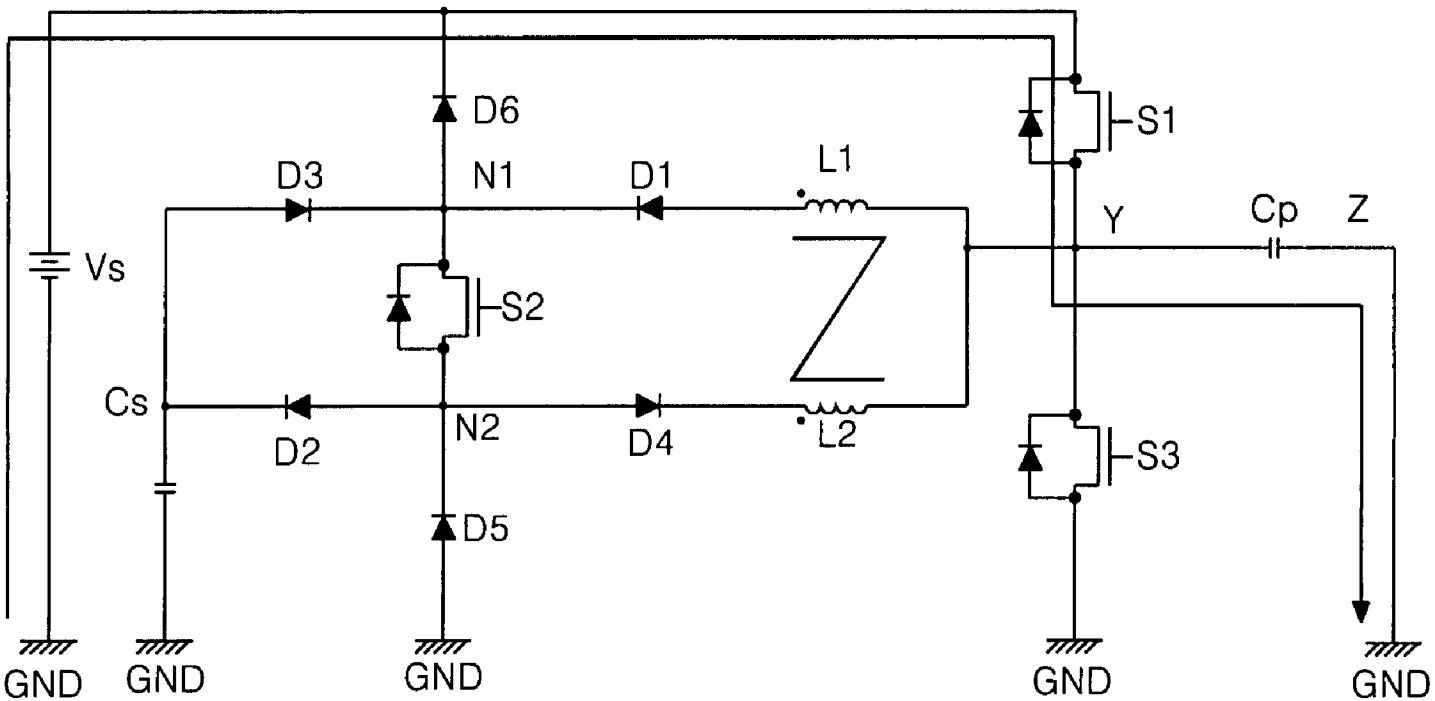
FIG. 11 is a circuit diagram representing the current path in accordance with the switching state for the switches during the T2 period shown in FIG. 6.

During the T2 period, the first switch S1 is turned on in accordance with the high state of the first switching signal. At this point, the first switch S1 is turned on, e.g., 100 ns to 500 ns from the time the second switch S2 is turned off. Accordingly, as shown in FIG. 11, a current path is formed from the sustain voltage source Vs to the scan electrode Y of the panel capacitor Cp through the first switch S1, whereby, the panel capacitor Cp remains at the positive(+) sustain voltage Vs.

During the T3 period, the first switch S1 is turned off and the second switch S2 is turned on in accordance with the low state of the first switching signal and the high state of the second switching signal. Accordingly, as shown in FIG. 9, a current path is formed from the scan electrode Y of the panel capacitor Cp to the source capacitor Cs through the first inductor L1, the first diode D1, the first node N1, the second switch S2, the second node N2 and the second diode D2. Accordingly, the panel capacitor Cp, the first inductor L1 and the source capacitor Cs form a resonance loop. Thus, the panel capacitor Cp supplies the energy, which is stored by the LC resonance, to the first inductor L1. Accordingly, positive (+) current flows in the first inductor L1, which is coupled with the second inductor L2. When the energy stored at the first inductor L1 becomes maximized, i.e., the current flowing in the first inductor L1 is maximized, the first inductor L1 supplies the energy, stored therein by the LC resonance, to the source capacitor Cs. Thus, the energy stored at the panel capacitor Cp is recovered to the source capacitor Cs and the current flowing in the first inductor L1 decreases. The operation, as defined by the switching states in period T0 through T3, as described above, then repeats.

On the other hand, the second energy recovery unit 82 alternately operates with the first energy recovery unit 80 to supply the drive voltage to the panel capacitor Cp. Accordingly, sustain voltages Vs having opposite polarities are alternately supplied to the panel capacitor Cp. Thus, the sustain discharge is generated in discharge cells.

In the alternative, if the screen load of the PDP is large, the T1 period may be omitted. In this case, a double discharge might naturally be induced due to the load effect even though there is no second rising sustain pulse as shown in FIG. 5A, for example, as a result of the omission of the T1 period.

In accordance with the first exemplary embodiment of the present invention, the first to third switches S1 to S3 of the energy recovery unit are all turned off during the sustain period in order to achieve a double-discharge, thereby improving the luminescence efficiency, thus the load effect of the PDP decreases to enable a better display image. Further, the inductance of the second inductor L2 is greater than the inductance of the first inductor L1 so that the charging time of the panel capacitor Cp is faster and the discharging time is slower, thereby improving the discharge efficiency and the energy recovery efficiency.

Figure 12:
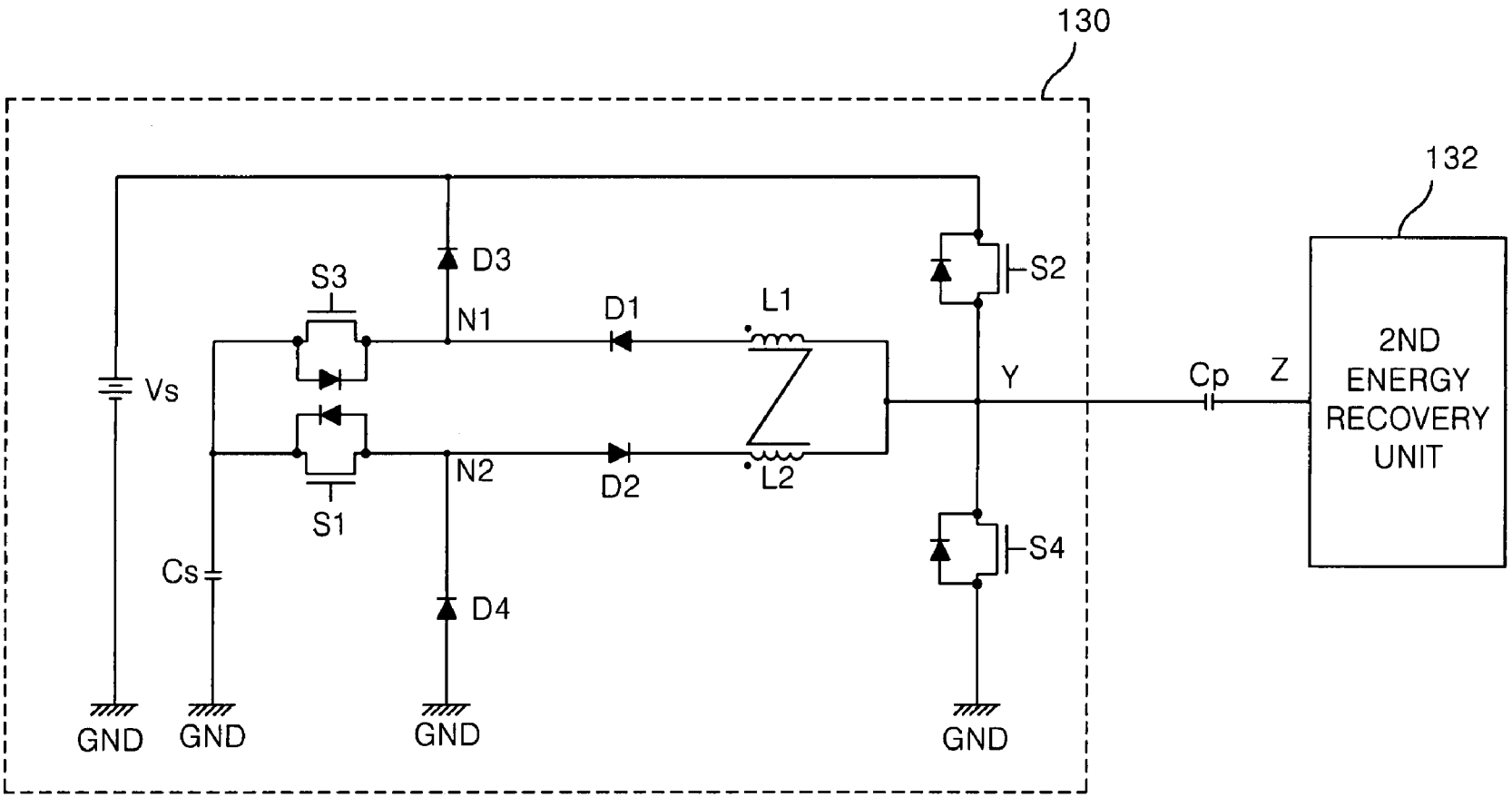
FIG. 12 is an energy recovery unit of a plasma display panel according to a second embodiment of the present invention.

FIG. 12 is a diagram representing an energy recovery unit of a plasma display panel according to the second exemplary embodiment of the present invention. As shown in FIG. 12, the energy recovery unit for the plasma display panel according to the second embodiment includes a panel capacitor Cp having a scan electrode Y and a sustain electrode Z; and first and second energy recovery units 130, 132 which supply a sustain voltage to the sustain electrode Z and the scan electrode Y of the panel capacitor Cp.

The first energy recovery unit 130 includes a sustain voltage source Vs which supplies a sustain voltage Vs to the panel capacitor Cp; a source capacitor Cs which recovers the energy stored at the panel capacitor; first and second inductors L1, L2 connected in parallel between the scan electrode Y of the panel capacitor Cp and the source capacitor Cs; a second switch S2 connected between the scan electrode Y of the panel capacitor Cp and the sustain voltage source Vs; a fourth switch S4 connected between the scan electrode Y of the panel capacitor Cp and a ground voltage source GND; a first diode D1 and a third switch S3 connected in series between the first inductor L1 and the source capacitor Cs; a first switch S1 and a second diode D2 connected in series between the second inductor L2 and the source capacitor Cs; a third diode D3 connected between the sustain voltage source Vs and a first node N1 between the first diode D1 and the third switch S3; a fourth diode D4 connected between ground voltage source GND and the second node N2 between the first switch S1 and the second diode D2.

The panel capacitor Cp equivalently represents the capacitance which is formed between the scan electrode Y and the sustain electrode Z of the PDP. The panel capacitor Cp generates a sustain discharge that has alternating sustain voltages of opposite polarity.

The source capacitor Cs supplies the energy stored therein to the panel capacitor to charge the panel capacitor Cp. The source capacitor then recovers the energy stored in the panel capacitor Cp.

The first and second inductors L1, L2 are connected in parallel, between the panel capacitor Cp and the source capacitor Cs, such that they are magnetically coupled. The first and second inductors L1, L2 recover the energy from the panel capacitor Cp, in accordance with the switching states of the first through the fourth switches S1 to S4, by storing the recovered energy. They also recover the energy from the source capacitor Cs. The first inductor recovers the energy from the panel capacitor Cp by supplying energy, stored due to the LC resonance with the source capacitor Cs, to the source capacitor Cs. The second inductor L2 recovers the energy from the source capacitor Cs by supplying energy, stored due to the LC resonance with the panel capacitor, to the panel capacitor Cp. The first and second inductors L1, L2 may have the same inductance or different inductances. At this moment, if the first and second inductors L1, L2 have the same inductance, the charge time and the discharge time of the panel capacitor Cp will be the same or substantially the same. To the contrary, if the inductance of the second inductor L2 is greater than the inductance of the first inductor L1, the charge time of the panel capacitor Cp becomes faster and the discharge time becomes slower, thus the discharge efficiency and the energy recovery efficiency is improved.

In general, the first switch S1 is switched in accordance with a first switching signal to electrically connect the source capacitor Cs with the second node N2. Thus, the energy stored at the source capacitor Cs is supplied to the panel capacitor Cp through the second inductor L2. The second switch S2 is switched in accordance with a second switching signal to electrically connect the sustain voltage source Vs to the scan electrode Y of the panel capacitor Cp. Thus, the sustain voltage Vs from the sustain voltage source Vs is supplied to the scan electrode Y of the panel capacitor Cp. The third switch S3 is switched in accordance with a third switching signal to electrically connect the first node N1 with the source capacitor Cs. Thus, the energy stored at the panel capacitor Cp is supplied to the source capacitor Cs through the first inductor L1. The fourth switch S4 is switched in accordance with a fourth switching signal to electrically connect the ground voltage source GND with the scan electrode Y of the panel capacitor Cp. Thus, the ground voltage GND is supplied to the scan electrode Y of the panel capacitor Cp. The first through the fourth switches S1 to S4 are turned on and off in accordance with the first through the fourth switching signals, respectively, to control the flow of current in accordance with the method of the second exemplary embodiment. The first through the fourth switches S1 to S4 are each composed of a semiconductor switch device, e.g., any one of a MOSFET, IGBT, SCR, and a BJT.

The first diode D1 is connected between the first inductor L1 and the first node N1 to prevent the flow of reverse current from the source capacitor Cs. The second diode D2 is connected between the second node N2 and the second inductor L2 to prevent the flow of reverse current from the panel capacitor Cp. Further, the third diode D3 is connected between the first node N1 and the sustain voltage source Vs to prevent the flow of reverse current from the sustain voltage source Vs, and the fourth diode D4 is connected between the ground voltage source GND and the second node N2 to maintain the voltage of the second node N2 at GND.

The second energy recovery unit 132 may be configured in the same manner as the first energy recovery unit 130, or it may be configured like the related art circuit. On the other hand, the first energy recovery unit 130 may be configured like the related art circuit and the second energy recovery unit 132 may be configured as the first energy recovery unit 130 is shown in FIG. 12.

Figure 13:
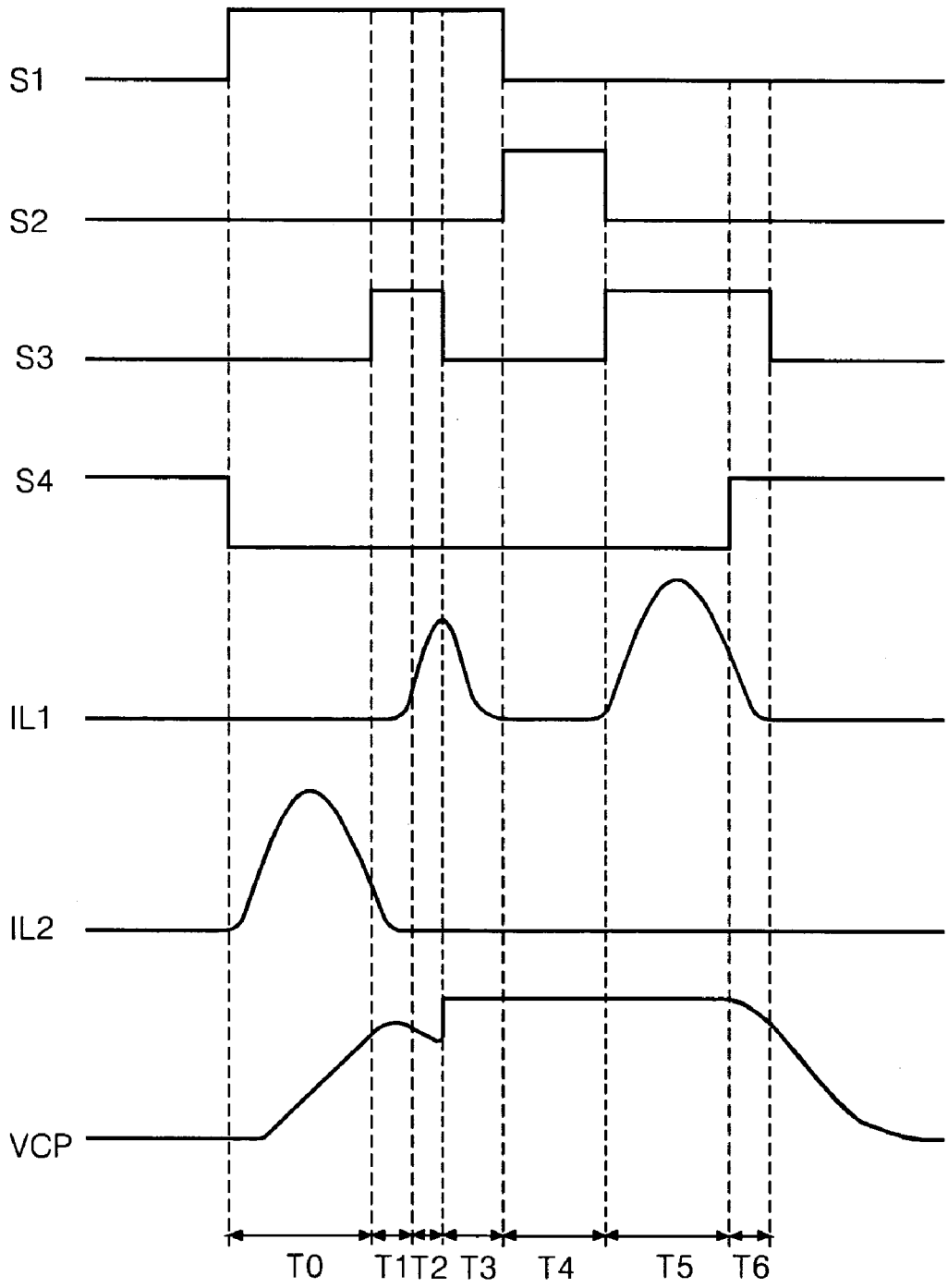
FIG. 13 is a timing and waveform diagram representing the output waveform of a panel capacitor and the switching states for the switches shown in FIG. 12.

FIG. 13 is a timing and waveform diagram representing the current in the first and second inducers L1 and L2, and the voltage applied to the panel capacitor Cp given the on/off states of switches S1 through S4, as shown in FIG. 13.

Herein, it is assumed that the sustain voltage Vs is stored at the source capacitor Cs.

Figure 14:
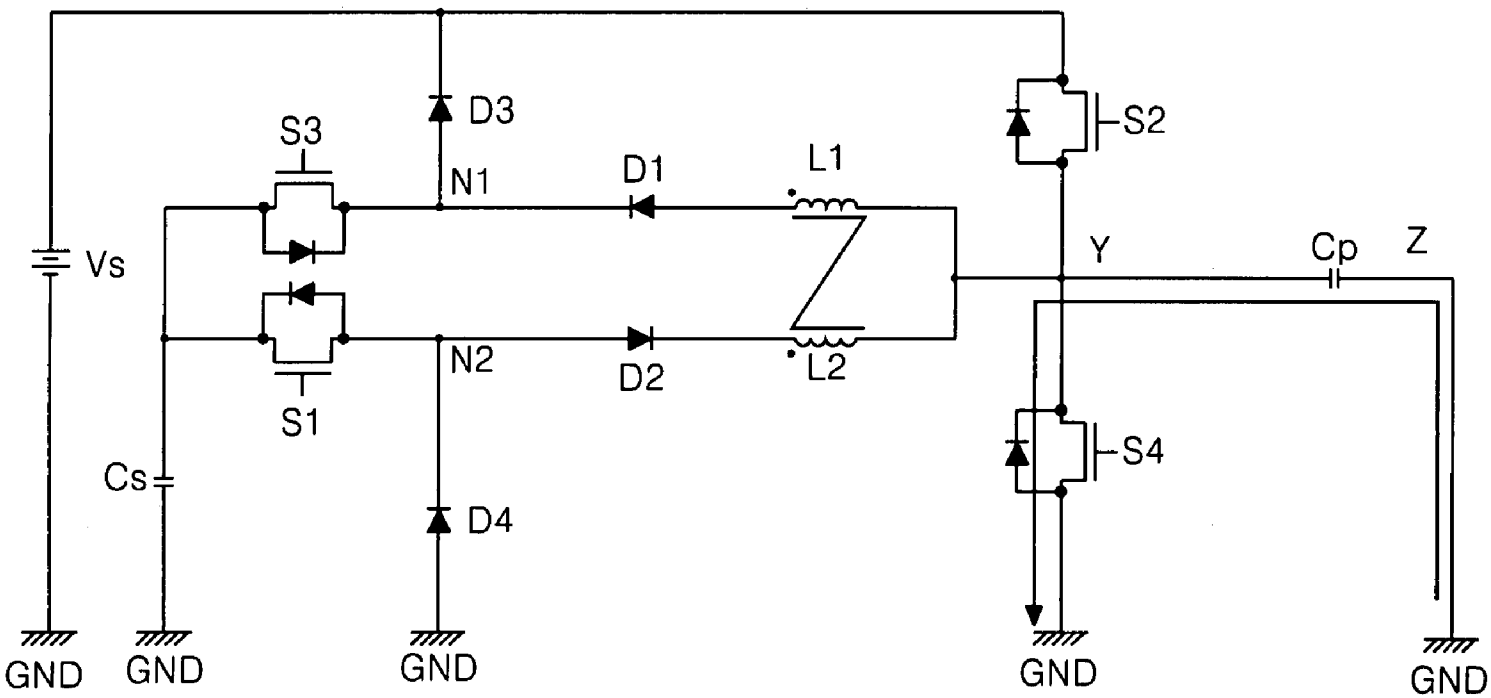
FIG. 14 is a circuit diagram representing the current path in accordance with the switching state for the switches before the T0 period shown in FIG. 13.

Referring now to FIG. 13, firstly, the fourth switch S4 is turned on in accordance with the fourth switching signal transitioning to a high state prior to the T0 period. Accordingly, a loop is formed from ground voltage source GND to ground voltage source GND through the panel capacitor Cp and the fourth switch S4, as shown in FIG. 14. Because of this, the ground voltage GND is supplied to the scan electrode Y of the panel capacitor Cp, and the panel capacitor Cp remains at the ground voltage GND.

Figure 15:
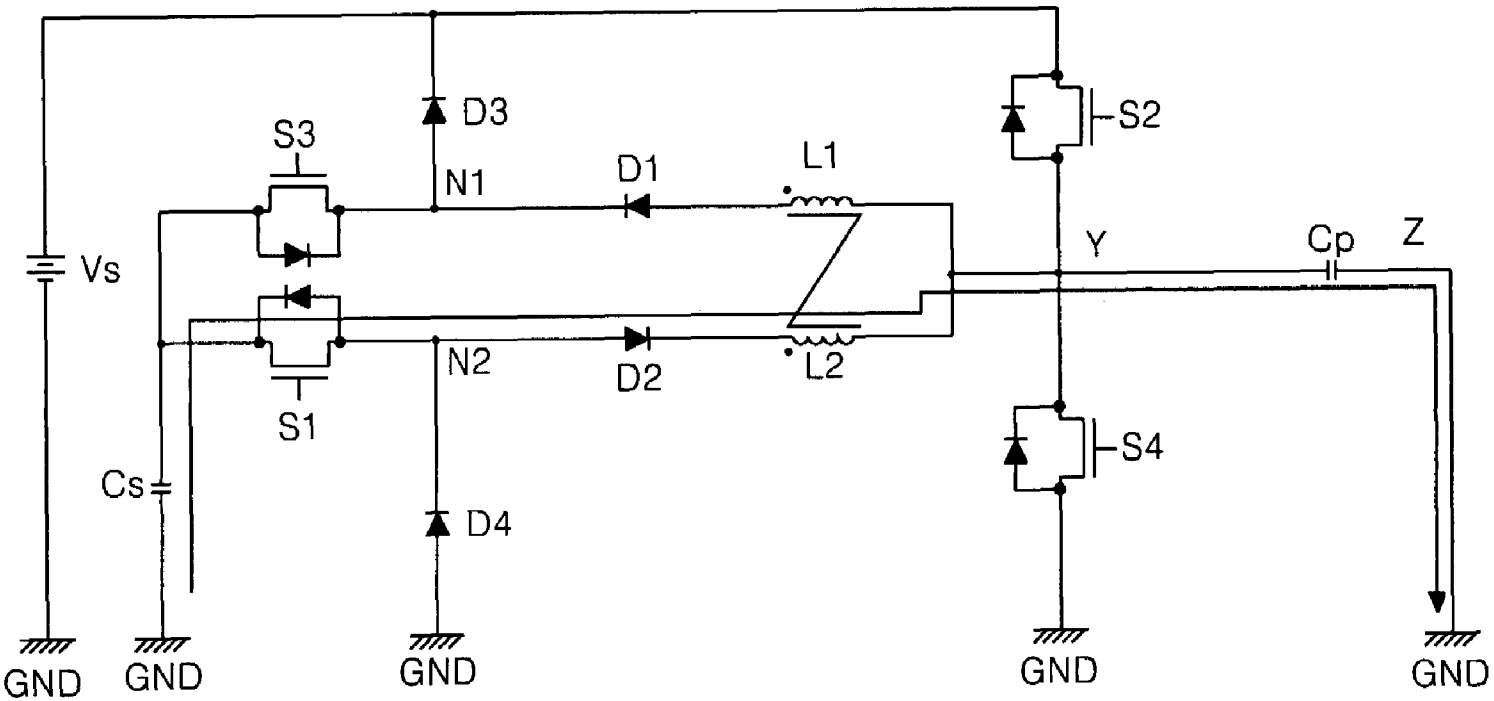
FIG. 15 is a circuit diagram representing the current path in accordance with the switching state for the switches during the T0 period shown in FIG. 13.

During the T0 period, the fourth switch S4 is turned off and the first switch S1 is turned on in accordance with the fourth switching signal transitioning to a low state and the first switching signal transitioning to a high state. The first switching signal remains at the high state for not less than ¼ of the time period when the panel capacitor Cp is being charged to the sustain voltage Vs. Accordingly, as shown in FIG. 15, a current path is formed from the source capacitor Cs to the scan electrode Y of the panel capacitor Cp through the first switch S1, the second node N2, the second diode D2 and the second inductor L2. As a result, the source capacitor Cs, the second inductor L2 and the panel capacitor Cp form a resonance loop, whereby the source capacitor Cs supplies the energy, stored by the LC resonance with the second inductor L2, to the second inductor L2. Accordingly, a positive(+) current flows in the second inductor L2 as shown in FIG. 13. That is, the second inductor L2 stores the energy supplied from the source capacitor Cs. When the energy stored at the second inductor L2 is maximized, i.e., the current flowing in the second inductor L2 is maximized, the second inductor L2 supplies the energy, stored therein by the LC resonance with the panel capacitor Cp, to the panel capacitor Cp. Accordingly, the panel capacitor Cp is charged by a voltage that rises from the ground voltage GND to the sustain voltage Vs, and the current flowing in the second inductor L2 decreases.

Figure 16:
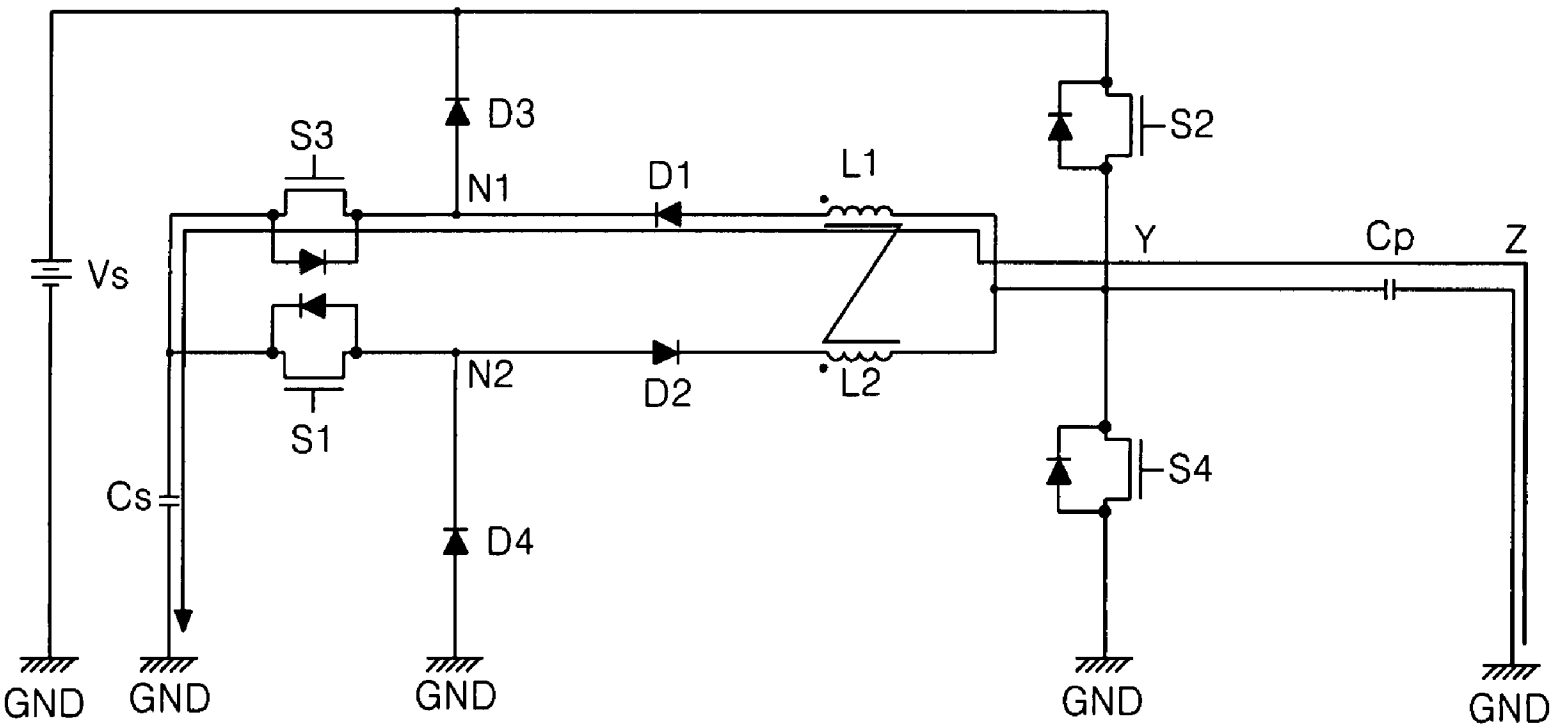
FIG. 16 is a circuit diagram representing the current path in accordance with the switching state for the switches during the T1 period shown in FIG. 13.

During the T1 period, the third switch S3 is turned on in accordance with the third switching signal transitioning to a high state. The third switching signal transitions from the low state to the high state prior to the ¼ time period of the sustain cycle (i.e., before the current in the second inductor L2 is 0. The third switching signal may transition to the high state at the same point of time as the first switching signal. Further, the third switching signal remains at the on state after ¼ time period, i.e., after the point of time when the current flowing in the second inductor L2 is 0. Accordingly, a first current path is formed from the source capacitor Cs to the scan electrode Y of the panel capacitor Cp through the first switch S1, the second node N2, the second diode D2 and the second inductor L2, as shown in FIG. 15, and a second current path from the scan electrode Y of the panel capacitor Cp to the source capacitor Cs through the first inductor L1, the first diode D1, the first node N1 and the third switch S3, as shown in FIG. 16. As a result of the second current path, the panel capacitor Cp, the first inductor L1 and the source capacitor Cs form a resonance loop. When this occurs, the panel capacitor Cp supplies the energy, stored by the LC resonance with the first inductor L1, to the first inductor L1. Accordingly, a positive (+) current flows in the first inductor L1 which is to the second inductor, as shown in FIG. 13. That is, the first inductor L1 stores the energy supplied by the panel capacitor Cp. The third switching signal does not remain in the high state during the time period when the energy stored at the panel capacitor Cp is supplied to the first inductor L1. Thus the current flowing in the first inductor L1 is less than the current that flowed in the second inductor L2, as shown in FIG. 13. Accordingly, the panel capacitor Cp discharges only a designated amount energy of the energy that is stored therein.

Figure 17:
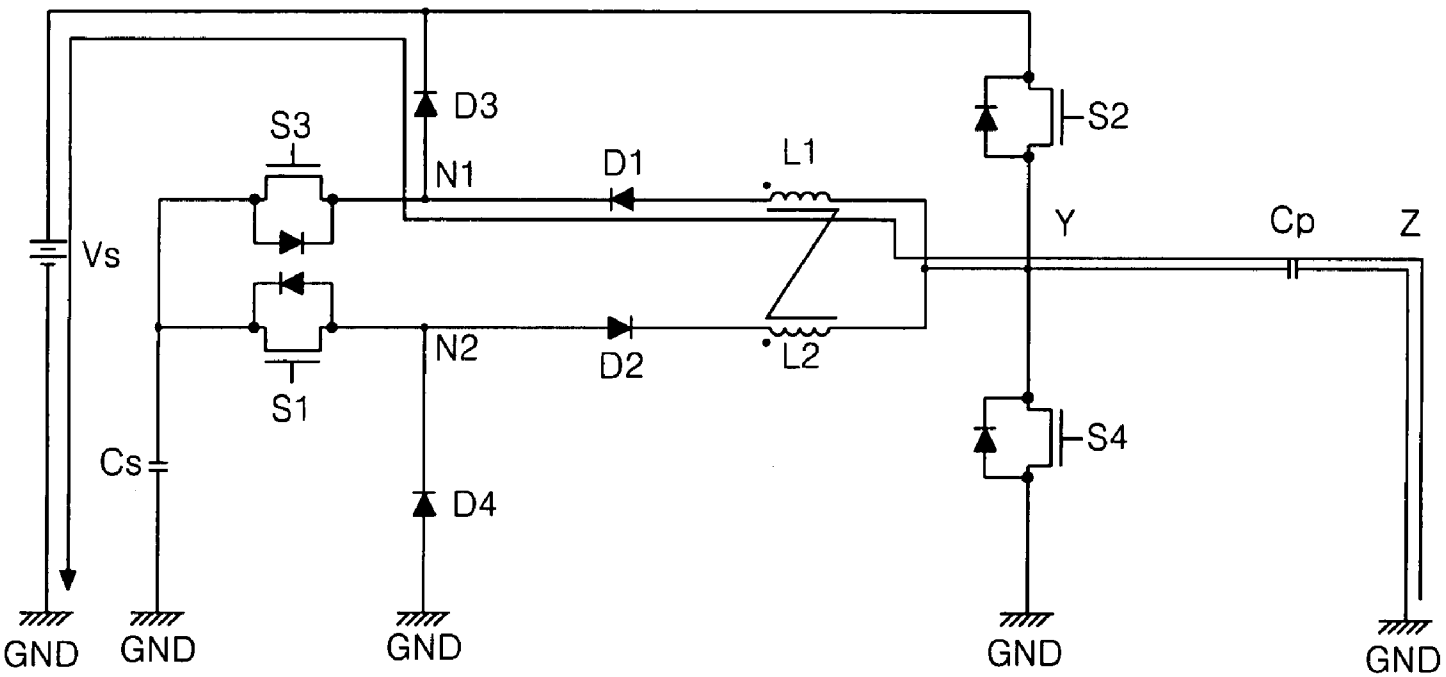
FIG. 17 is a circuit diagram representing the current path in accordance with the switching state for the switches during the T2 period shown in FIG. 13.

During the T2 period, the third switch S3 is turned off in accordance with the third switching signal transitioning to a low state. Accordingly, a first current path is formed from the source capacitor Cs to the scan electrode Y of the panel capacitor Cp through the first switch S1, the second node N2, the second diode D2 and the second inductor L2, and a second current path is formed from the ground voltage source GND to the sustain voltage source Vs through the panel capacitor Cp, the first inductor L1, the first diode D1, the first node N1 and the third diode D3 as shown in FIG. 17. As a result of the second current path, a positive(+) current flowing in the first inductor L1 is recovered to the sustain voltage source Vs, thus the current flowing in the first inductor L1 decreases.

During the T3 period, the third switch S3 remains off and the second switch S2 is turned on in accordance with the second switching signal which transitions from a low state to a high state. The second switching signal transitions to the high state after a designated time, e.g., 100 ns to 500 ns after the third switching signal transitions to the low state. When the second switch S2 is turned on, a first current path is formed from the source capacitor Cs to the scan electrode Y of the panel capacitor Cp through the first switch S1, the second node N2, the second diode D2 and the second inductor L2, and a second current path is formed from the sustain voltage source Vs to the scan electrode Y of the panel capacitor Cp through the second switch S2. As a result of the second current path, the panel capacitor is maintained at the positive (+) sustain voltage Vs.

Figure 18:
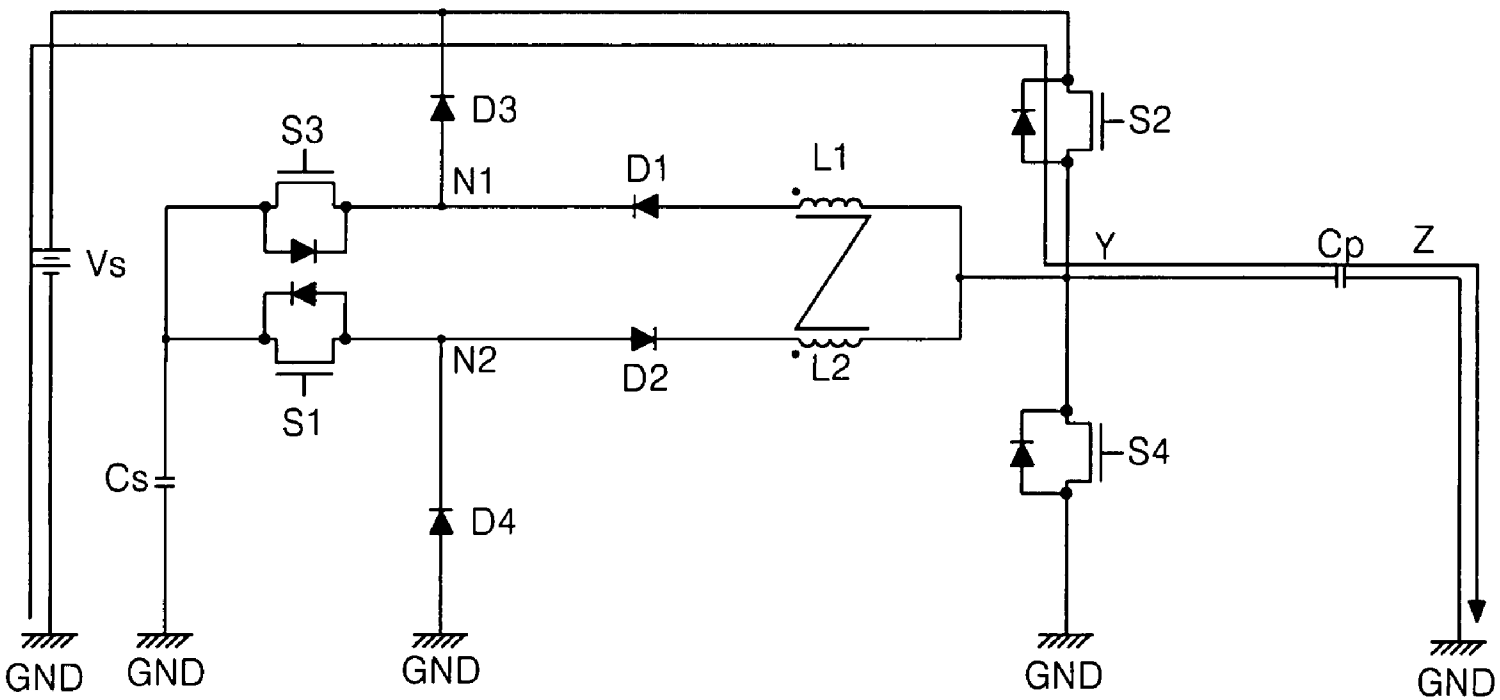
FIG. 18 is a circuit diagram representing the current path in accordance with the switching state for the switches during the T3 period shown in FIG. 13.

During the T4 period, the first switch S1 is turned off in accordance with the first switching signal transitioning to a low state while the second switch S2 remains in the high state. Accordingly, there remains a current path from the sustain voltage source Vs to the scan electrode Y of the panel capacitor Cp through the second switch S2, as shown in FIG. 18, thus the panel capacitor Cp again remains at the positive(+) sustain voltage Vs in the same manner as in the T3 period.

Figure 19:
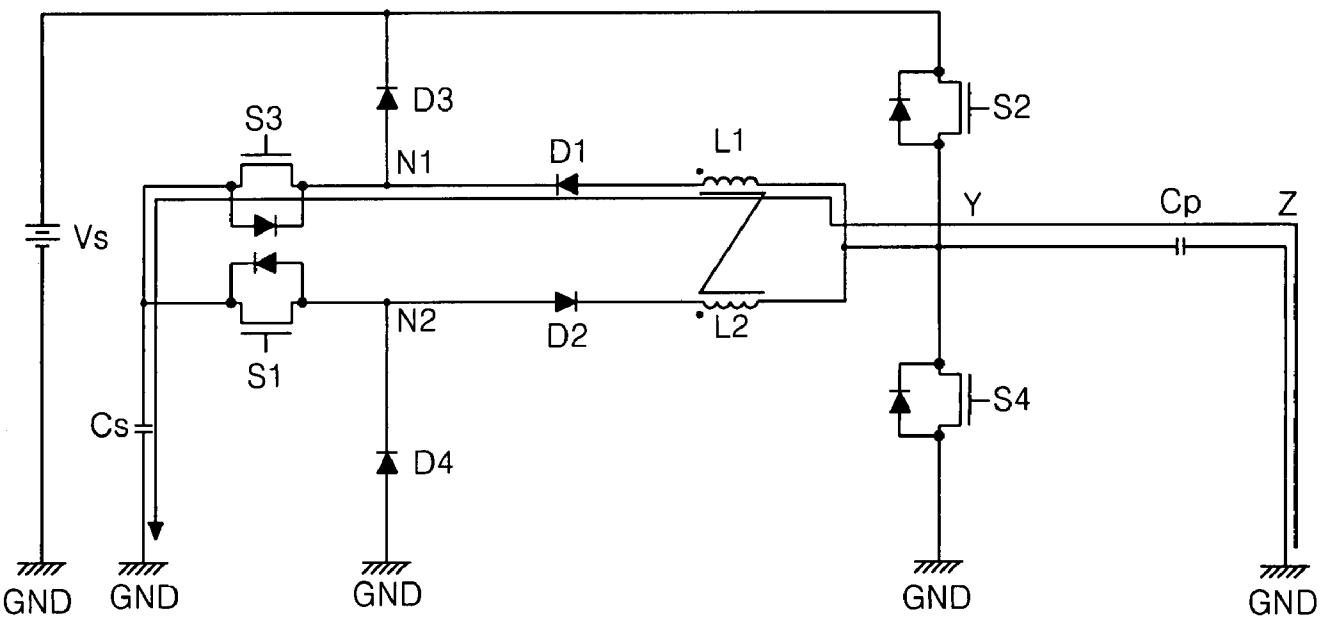
FIG. 19 is a circuit diagram representing the current path in accordance with the switching state for the switches during the T5 period shown in FIG. 13.
Figure 20:
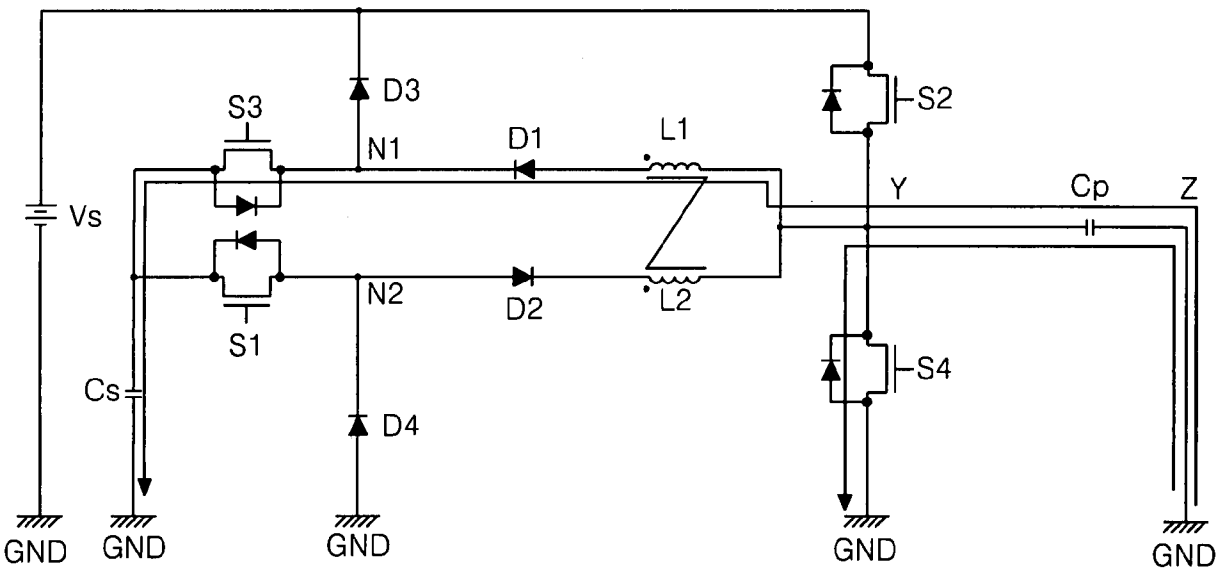
FIG. 20 is a circuit diagram representing the current path in accordance with the switching state for the switches during the T6 period shown in FIG. 13.

During the T5 period, the second switch S2 is turned off and the third switch S3 is turned on in accordance with the second switching signal transitioning to a low state and the third switching signal transitioning to a high state. Accordingly, a current path is formed from the scan electrode Y of the panel capacitor Cp to the source capacitor Cs through the first inductor L1, the first diode D1, the first node N1 and the third switch S3, as shown in FIG. 19. As a result, the panel capacitor Cp, the first inductor L1 and the source capacitor Cs form a resonance loop. Thus, the panel capacitor Cp supplies the energy, stored by the LC resonance with the first inductor L1, to the first inductor L1. Accordingly, a positive(+) current flows in the first inductor L1 that is connected to be coupled with the second inductor L2, as shown in FIG. 13. When the energy stored at the first inductor L1 is maximized, i.e., the current flowing in the first inductor L1 is maximized, the first inductor L1 supplies the energy, stored by the LC resonance with the source capacitor Cs, to the source capacitor Cs. Thus, the energy stored at the panel capacitor Cp is recovered to the source panel capacitor Cs and the current flowing in the first inductor L1 decreases.

During the T6 period, the fourth switch S4 is turned on in accordance with the fourth switching signal which transitions to a high state. Accordingly, a first current path is formed from the scan electrode Y of the panel capacitor Cp to the source capacitor Cs through the first inductor L1, the first diode D1, the first node N1 and the third switch S3, and a second current path is formed from the ground voltage source GND to the ground voltage source though the panel capacitor Cp and the fourth switch S4. As a result of the second current path, the panel capacitor Cp is kept at the ground voltage GND.

After the T6 period, the third switch S3 is turned off in accordance with the third switching signal transitioning to a low state. Accordingly, the current path from the ground voltage source GND to the ground voltage source through the panel capacitor Cp and the fourth switch S4 is maintained, and the panel capacitor Cp is kept at the ground voltage GND in the same manner as in the T6 period. If the fourth switching signal transitions to the high state when the third switching signal transitions to the low state, the aforementioned first current path formed during the T6 period is not formed and the T6 period is omitted and the switching state is as previously described just prior to the T0 period. The operation in accordance with the T0 period through the T6 period then repeats.

The second energy recovery unit 132 is alternately operated with the first energy recovery unit 130 to supply the drive voltage to the panel capacitor Cp. Accordingly, a sustain voltage Vs having alternating, opposing polarities is alternately supplied to the panel capacitor Cp. Thus the sustain discharge is generated in discharge cells.

The plasma display panel according to the second embodiment of the present invention discharges, i.e., double-discharges, part of the energy, stored at the panel capacitor, by turning the third switch S3 on and off during a partial period when the first switch S1 remains on. However, if the screen load of the PDP is large, the third switch S3 may not be turned on while the first switch S1 remains on.

The plasma display panel according to the second embodiment of the present invention controls the switching timing for the first through the fourth switches S1 to S4 to achieve a double-discharge, thereby improving the luminescence efficiency, and reducing the load effect of the PDP in order to display a better image. Further, the inductance of the second inductor L2 is made greater than the inductance of the first inductor L1 such that the charging time of the panel capacitor Cp is faster and the discharging time is slower, thereby improving the discharge efficiency and the energy recovery efficiency.

A plasma display panel and a driving method thereof according to a third exemplary embodiment of the present invention calculate the load associated with each subfield in accordance with the amount of video data. If the load of a given subfield is calculated to be a value between 20% and 50%, a double discharge sustain pulse is generated as described in the foregoing embodiments. On the other hand, the display device and the driving method thereof according to the present invention generates a sustain pulse in accordance with the related art if the load amount of the subfield is not less than 50%. On the other hand, if the load of the subfield is 100%, it means that all the cells within the screen are selected by the address discharge in the corresponding subfield to generate the sustain discharge.

As described above, the plasma display panel and the driving method thereof according to the present invention can reduce the discharge current by discharging the discharge cell at least twice during one sustain pulse, and improve the discharge efficiency and the luminescence efficiency. Further, the plasma display panel and the driving method thereof according to the present invention achieve a double-discharge by modulating the sustain pulse in the same manner as the double discharge which is naturally generated when the load of the PDP is large, thus it can reduce the load effect of the PDP. Moreover, the inductance of the inductor, which controls the charging time of the capacitive load of the PDP, is set to be greater than the inductance of the inductor, which controls the discharging time, so that the charging time is faster and the discharging time is slower, thereby improving the discharge efficiency and the energy recovery efficiency of the plasma display panel.

Although the present invention has been explained by the embodiments shown in the drawings described above, it should be understood to the ordinary skilled person in the art that the invention is not limited to these embodiments, but rather, various changes or modifications thereof are possible without departing from the spirit of the invention. Accordingly, the scope of the invention shall be determined only by the appended claims and their equivalents.

What is claimed is:

1. A plasma display panel, comprising:

a capacitive load;

a source capacitor;

a sustain voltage source to generate a sustain voltage;

a first inductor on a first current path from the capacitive load to the source capacitor;

a second inductor on a second current path from the source capacitor to the capacitive load;

a first switch connected between the capacitive load and the sustain voltage source;

a second switch connected between a first node on the first current path and a second node on the second current path;

a third switch connected between the capacitive load and a ground voltage source; and a switch control circuit configured to control said switches in order to generate a first discharge and a second discharge during one sustain pulse.

2. The plasma display panel according to claim 1, further comprising:

a first diode connected between the first inductor and the first node;

a second diode connected between the second node and the source capacitor;

a third diode connected between the source capacitor and the first node;

a fourth diode connected between the second node and the second inductor;

a fifth diode connected between the ground voltage source and the second node; and a sixth diode connected between the first node and the sustain voltage source.

3. The plasma display panel according to claim 1, wherein the second switch remains at an on state after current flowing in the second inductor becomes 0 during the one sustain pulse.

4. The plasma display panel according to claim 1, wherein current associated with the first inductor changes due to energy stored by the capacitive load after current flowing in the second inductor becomes 0.

5. The plasma display panel according to claim 4, wherein the first and third switches remain at an off state while current is flowing in the first inductor.

6. The plasma display panel according to claim 1, wherein the first switch is turned on at a designated time after the second switch is turned off during the one sustain pulse.

7. The plasma display panel according to claim 6, wherein the designated time is between 100 ns and 500 ns.

8. The plasma display panel according to claim 1, the first and second inductors have the same inductance.

9. The plasma display panel according to claim 1, wherein the first inductor has a different inductance than the second inductor.

10. The plasma display panel according to claim 9, wherein the second inductor has an inductance that is greater than the inductance of the first inductor.

11. The plasma display panel according to claim 1, wherein a coil associated with the first inductor and a coil associated with the second inductor are wound in one core.

12. A plasma display panel, comprising:

a capacitive load;

a source capacitor;

a sustain voltage source to generate a sustain voltage;

a first inductor on a first current path from the capacitive load to the source capacitor;

a second inductor on a second current path from the source capacitor to the capacitive load;

a first switch connected between the source capacitor and the second inductor;

a second switch connected between the sustain voltage source and the capacitive load;

a third switch connected between the source capacitor and the first inductor on the first current path;

a fourth switch connected between the capacitive load and a ground voltage source; and a switch control circuit configured to control said switches so as to generate a first discharge a second discharge during one sustain pulse.

13. The plasma display panel according to claim 12, further comprising:

a first diode connected between the first inductor and the third switch;

a second diode connected between the first switch and the second inductor;

a third diode connected between the sustain voltage source and a first node between the third switch and the first diode; and a fourth diode connected between the ground voltage source and a second node between the first switch and the second diode.

14. The plasma display panel according to claim 12, wherein the first switch is at an on state while current is flowing in the second inductor, and wherein the first switch remains at the on state after the current flowing in the second inductor becomes 0.

15. The plasma display panel according to claim 14, wherein the third switch is turned on while the first switch is in the on state.

16. The plasma display panel according to claim 15, wherein the third switch forms a current path between the capacitive load and the source capacitor.

17. The plasma display panel according to claim 15, wherein the third switch is turned on after a point of time when current flowing in the second inductor becomes 0.

18. The plasma display panel according to claim 12, wherein the second switch forms a current path between the sustain voltage source and the capacitive load.

19. The plasma display panel according to claim 18, wherein the second switch is turned on at a designated time after the third switch is turned off.

20. The plasma display panel according to claim 19, wherein the designated time is between 100 ns and 500 ns.

21. The plasma display panel according to claim 12, wherein the first inductor has a different inductance than the second inductor.

22. The plasma display panel according to claim 21, wherein the inductance of the second inductor is greater than the inductance of the first inductor.

23. The plasma display panel according to claim 12, wherein a coil associated with the first inductor and a coil associated with the second inductor are wound in one core.

24. A driving method of a plasma display panel that includes a capacitive load, a source capacitor, a sustain voltage source, a first inductor on a first current path from the capacitive load and the source capacitor, and a second inductor on a second current path from the source capacitor to the capacitive load, the second inductor coupled to and parallel with the first inductor, said method comprising:

supplying a ground voltage level to the capacitive load;

storing energy from the source capacitor at the second inductor;

charging the capacitive load by supplying the energy stored at the second inductor to the capacitive load;

discharging the energy stored at the capacitive load;

supplying a sustain voltage from the sustain voltage source to the capacitive load;

storing the energy from the capacitive load at the first inductor; and charging the source capacitor by supplying the energy stored at the first inductor to the source capacitor.

25. The driving method according to claim 24, wherein the step of supplying a ground voltage level to the capacitive load comprises the step of:

connecting the capacitive load with a ground voltage source by turning on a switch connected between the ground voltage source and the capacitive load.

26. The driving method according to claim 24, wherein the step of storing energy from the source capacitor at the second inductor comprises the step of:

forming a current path between the source capacitor and the capacitive load by turning on a switch connected between the source capacitor and the second inductor.

27. The driving method according to claim 26, wherein the switch remains at an on state after current flowing in the second inductor becomes 0.

28. The driving method according to claim 24 further comprising the steps of:

storing energy from the capacitive load at the first inductor; and supplying the energy stored at the first inductor to the sustain voltage source.

29. The driving method according to claim 24, wherein the step of supplying the sustain voltage to the capacitive load comprises the step of:

forming a current path between the sustain voltage source and the capacitive load by turning on a switch connected between the sustain voltage source and the capacitive load.

30. The driving method according to claim 29, wherein the switch is turned on at a designated time after a second switch between the source capacitor and the first inductor is turned off.

31. The driving method according to claim 30, wherein the designated time is between 100 ns and 500 ns.

32. The driving method according to claim 24, wherein the steps of storing the energy from the capacitive load in the first inductor and charging the source capacitor by supplying the energy at the first inductor to the source capacitor comprise the step of:

forming a current path between the capacitive load and the source capacitor by turning on a switch between the first inductor and the source capacitor.

33. The driving method according to claim 24, wherein the step of storing energy from the source capacitor at the second inductor and the step of charging the capacitive load by supplying the energy stored at the second inductor to the capacitive load comprise the step of:

forming a current path between the source capacitor and the capacitive load by turning on a switch connected between the source capacitor and the second inductor.

34. The driving method according to claim 24, wherein the step of discharging the energy stored at the capacitive load comprises the steps of:

storing a portion of the energy from the capacitive load at the first inductor; and charging the source capacitor by supplying the energy at the first inductor to the source capacitor.

35. The driving method according to claim 34, wherein the step of storing a portion of the energy from the capacitive load at the first inductor and the step of charging the source capacitor by supplying the energy at the first inductor to the source capacitor comprise the step of:

forming a current path between the capacitive load and the source capacitor by turning on a switch connected between the source capacitor and the first inductor.

36. The driving method according to claim 35, wherein the switch remains at an on state until after current flowing in the second inductor becomes 0.

* * * * *